US009728156B2

(12) United States Patent
Song et al.

(10) Patent No.: US 9,728,156 B2
(45) Date of Patent: Aug. 8, 2017

(54) DISPLAY APPARATUS

(71) Applicant: Samsung Display Co., LTD., Yongin, Gyeonggi-Do (KR)

(72) Inventors: Hee-Rim Song, Seoul (KR); Kwang-Chul Jung, Seongnam-si (KR); Il-Gon Kim, Seoul (KR); Se-Young Song, Hwaseong-si (KR)

(73) Assignee: Samsung Display Co., Ltd., Samsung-ro, Gibeung-Gu, Yongin-si, Gyeonggi-Do (KR)

( * ) Notice: Subject to any disclaimer, the term of this patent is extended or adjusted under 35 U.S.C. 154(b) by 111 days.

(21) Appl. No.: 14/693,728

(22) Filed: Apr. 22, 2015

(65) Prior Publication Data

US 2016/0133216 A1 May 12, 2016

(30) Foreign Application Priority Data

Nov. 7, 2014 (KR) ..... 10-2014-0154697

(51) Int. Cl.
*G09G 3/36* (2006.01)

(52) U.S. Cl.
CPC ..... *G09G 3/3696* (2013.01); *G09G 3/3677* (2013.01); *G09G 2320/0219* (2013.01)

(58) Field of Classification Search
CPC .. G09G 3/3696; G09G 3/3677; G09G 3/3666; G09G 2200/0426; G09G 2200/043; G09G 2320/0219; G09G 2320/0223; G02F 1/136826; G02F 1/136213; G02F 2001/13629
See application file for complete search history.

(56) References Cited

U.S. PATENT DOCUMENTS

2005/0259063 A1 11/2005 Kwon
2006/0012729 A1* 1/2006 Tanaka ..... G02F 1/1345 349/54
2008/0068321 A1 3/2008 Kim et al.
2008/0068358 A1 3/2008 Lee et al.
2015/0340001 A1* 11/2015 Jung ..... G02F 1/136286 345/205
2016/0005351 A1* 1/2016 Jeon ..... G09G 3/20 345/204

FOREIGN PATENT DOCUMENTS

KR 1020110042674 A 4/2011
KR 1020130096536 A 8/2013
KR 1020130102185 A 9/2013
KR 10-2016-0005292 A 1/2016

* cited by examiner

*Primary Examiner* — Tom Sheng

(57) ABSTRACT

A display apparatus includes a display panel comprising a plurality of gate lines extending in a first diagonal direction of a display area, and a plurality of vertical lines extending in a vertical direction, the gate lines comprising a plurality of first gate lines disposed in a first sub-area of the display area, a plurality of second gate lines disposed in a second sub-area of the display area, a plurality of third gate lines disposed in a third sub-area of the display area, the third gate lines respectively connected to the vertical lines, and a gate driver disposed in the first peripheral area in which the data driver is disposed and configured to provide at least one of the first, second and third sub-areas with a gate signal different from a reference gate signal.

19 Claims, 15 Drawing Sheets

DISPLAY APPARATUS

CLAIM OF PRIORITY

This application claims the priority from and all the benefits accruing under 35 U.S.C. §119 of Korean Patent Application No. 10-2014-0154697, filed on Nov. 7, 2014 in the Korean Intellectual Property Office ("KIPO"), which is hereby incorporated by reference for all purposes as if fully set forth herein.

BACKGROUND OF THE INVENTION

Field of the Invention

Exemplary embodiments of the inventive concept relate to a display apparatus. More particularly, example embodiments of the inventive concept relate to a display apparatus for improving a display quality.

Description of the Related Art

Generally, a liquid crystal display (LCD) apparatus has a relatively small thickness, low weight and low power consumption. Thus the LCD apparatus is used in monitors, laptop computers and cellular phones, etc. The LCD apparatus includes an LCD panel displaying images using a selectively changeable light transmittance characteristic of a liquid crystal while a backlight assembly disposed under the LCD panel provides light to the LCD panel. A driving circuit drives the LCD panel and thereby causes the selective changes of the light transmittance characteristic of the liquid crystals.

SUMMARY OF THE INVENTION

The LCD panel includes an array substrate which has a plurality of gate lines, a plurality of crossing data lines, a plurality of thin film transistors and corresponding pixel electrodes. The LCD panel also includes an opposing substrate which has a common electrode. An LC layer is interposed between the array substrate and opposing substrate. The driving circuit includes a gate driving part which drives the gate lines of the array substrate and a data driving part which drives the data lines.

The LCD panel includes a display area displaying an image and a peripheral area surrounding the display area. The gate driving part and the data driving part are disposed in the peripheral area. A black matrix layer is disposed in the peripheral area. When the peripheral area increases, an appearance quality decreases.

In addition, in a tiled display apparatus which includes a plurality of LCD panels connected to each other, the peripheral areas of an LCD panel form a black frame shape or a dark-gray frame shape in a boundary area between adjacent LCD panels. The frame shape in the boundary area is observed and thus, a display quality may be decreased.

Thus, when the peripheral area of the LCD panel decreases, the appearance quality and the display quality of the LCD apparatus increase. To solve this problem, a LCD display device is configured to have a display area divided into a plurality of sub-areas which may be driven by corresponding data circuits and gate circuits, and the LCD display device does not have the boundary peripheral areas between LCD panels. However, a sharp variation of kick-back voltage across the sub-areas may occur and a difference of luminance may be observed, deteriorating the display quality of the LCD display device. Therefore, a LCD display device having a display area divided into a plurality of sub-areas without luminance difference is desired.

Exemplary embodiments of the inventive concept provide a display apparatus for removing a luminance difference in a display area.

According to an exemplary embodiment of the inventive concept, there is provided a display apparatus. The display apparatus includes a display panel comprising a plurality of gate lines extending in a first diagonal direction of a display area, and a plurality of vertical lines extending in a vertical direction, the gate lines comprising a plurality of first gate lines disposed in a first area of the display area, a plurality of second gate lines disposed in a second area of the display area, a plurality of third gate lines disposed in a third area of the display area, the third gate lines respectively connected to the vertical lines, a data driver disposed in a first peripheral area among a plurality of peripheral areas surrounding the display area, and a gate driver disposed in the first peripheral area in which the data driver is disposed and configured to provide at least one of the first, second and third sub-areas with a gate signal different from a reference gate signal.

In an exemplary embodiment, lengths of the first gate lines in the first area may increase in a second diagonal direction crossing the first diagonal direction, lengths of the second gate lines in the second area may be the same as each other, and lengths of the third gate lines in the third area may decrease in the second diagonal direction.

In an exemplary embodiment, the gate driver may be configured to provide the first and second gate lines in the first and second sub-areas with a gate signal having a reference gate-on voltage, and provide the third gate lines in the third area with a gate signal having a gate-on voltage being higher than the reference gate-on voltage.

In an exemplary embodiment, the gate driver may be configured to provide the first and second gate lines in the first and second sub-areas with a gate signal having a gate-on voltage being lower than the reference gate-on voltage, and provide the third gate lines in the third area with a gate signal having the reference gate-on voltage.

In an exemplary embodiment, the gate driver may be configured to provide the first and third gate lines in the first and third sub-areas with a gate signal having the reference gate-on voltage, and sequentially provide the second gate lines in the second area with a plurality of gate signals having a plurality of gate-on voltages lower than the reference gate-on voltage and with decreasing levels.

In an exemplary embodiment, the gate driver may be configured to provide the first and second gate lines in the first and second sub-areas with a gate signal having the reference gate-on voltage, and sequentially provide the third gate lines in the third area with a plurality of gate signals having a plurality of gate-on voltages higher than the reference gate-on voltage and with decreasing levels.

In an exemplary embodiment, the gate driver may be configured to provide the first and second gate lines in the first and second sub-areas with a gate signal having a reference slice value, and provide the third gate lines in the third area with a gate signal having a slice value being smaller than the reference slice value.

In an exemplary embodiment, the gate driver may be configured to provide the first and second gate lines in the first and second sub-areas with a gate signal having a slice value being smaller than a reference slice value, provide the third gate lines in the third area with a gate signal having the reference slice value.

In an exemplary embodiment, the gate driver may be configured to provide the first and third gate lines in the first and third sub-areas with a gate signal having a reference slice value, and sequentially provide the second gate lines in the second area with a plurality of gate signals having a plurality of slice values larger than the reference slice value and with increasing slice values.

In an exemplary embodiment, the gate driver may be configured to provide the first and second gate lines in the first and second sub-areas with a gate signal having a reference slice value, and sequentially provide the third gate lines in the third area with a plurality of gate signals having a plurality of slice values smaller than the reference slice value and with decreasing slice values.

According to an exemplary embodiment of the inventive concept, there is provided a display apparatus. The display apparatus includes In an exemplary embodiment, a plurality of gate lines extending in a first diagonal direction of a display area, the gate lines comprising a plurality of first gate lines disposed in a first area, a plurality of second gate lines disposed in a second area, a plurality of third gate lines disposed in a third area, a plurality of vertical lines extending in a vertical direction and respectively connected to end portions of the third gate lines, a plurality of data lines extending in the vertical direction, a switching element comprising a gate/source capacitance between a source electrode connected to a data line and a gate electrode connected to a gate line, a liquid crystal capacitor comprising a pixel electrode connected to the switching element, a plurality of storage lines extending parallel with the gate lines and a storage capacitor comprising a storage electrode which is connected to a storage line and overlaps the pixel electrode, wherein at least one of a storage capacitance and the gate/source capacitance in at least one of the first, second and third areas changes gradually.

In an exemplary embodiment, lengths of the first gate lines in the first area may increase in a second diagonal direction crossing the first diagonal direction, lengths of the second gate lines in the second area may be the same as each other, and lengths of the third gate lines in the third area may decrease in the second diagonal direction.

In an exemplary embodiment, the display apparatus may further include a plurality of storage extension lines connected to end portions of the storage lines in the second area, wherein the storage extension lines have loads gradually changing.

In an exemplary embodiment, a plurality of storage capacitors connected to the storage lines in the second area may have a plurality of storage capacitances which gradually change along an alignment of the storage lines.

In an exemplary embodiment, the display apparatus may further include a plurality of gate extension lines connected to end portions of the third gate lines in the third area, wherein the gate extension lines have loads gradually changing.

In an exemplary embodiment, a plurality of gate/source capacitances of the switch elements connected to the third gate lines in the third area may gradually change along an alignment of the third gate lines.

According to an exemplary embodiment of the inventive concept, there is provided a display apparatus. The display apparatus includes a plurality of gate lines extending in a first diagonal direction of a display area, the gate lines comprising a plurality of first gate lines disposed in a first area, a plurality of second gate lines disposed in a second area, a plurality of third gate lines disposed in a third area; a plurality of vertical lines extending in a vertical direction and respectively connected to end portions of the third gate lines; a plurality of data lines extending in the vertical direction; a plurality of first gate extension lines connected to end portions of the first gate lines in the first area; and a plurality of second gate extension lines connected to end portions of the second gate lines in the second area.

In an exemplary embodiment, lengths of the first gate lines in the first area increase in a second diagonal direction crossing the first diagonal direction, lengths of the second gate lines in the second area are the same as each other, and lengths of the third gate lines in the third area decrease in the second diagonal direction.

In an exemplary embodiment, each of the first and second gate extension lines may have a load being the same as a load of a vertical line.

According to the inventive concept, a gate signal different from a reference gate signal is applied to at least one of the first, second and third sub-areas of the display area such that a kickback voltage of the display area is continuously changed. Thus, a luminance difference of the display area may be removed. In addition, at least one of a storage capacitance of a storage capacitor and a gate/source capacitance of a switching element in at least one of the first, second and third sub-areas may be gradually changed, and thus, the luminance difference of the display area may be removed. In addition, a gate extension line corresponding to a vertical line which is connected to a gate line in the third area is connected to a gate line in the first and second sub-areas and thus, the luminance difference of the display area may be removed.

BRIEF DESCRIPTION OF THE DRAWINGS

The above and other features and advantages of the inventive concept will become more apparent by describing in detailed exemplary embodiments thereof with reference to the accompanying drawings, in which.

DETAILED DESCRIPTION OF THE INVENTION

Hereinafter, the inventive concept will be explained in detail with reference to the accompanying drawings.

Figure 1:
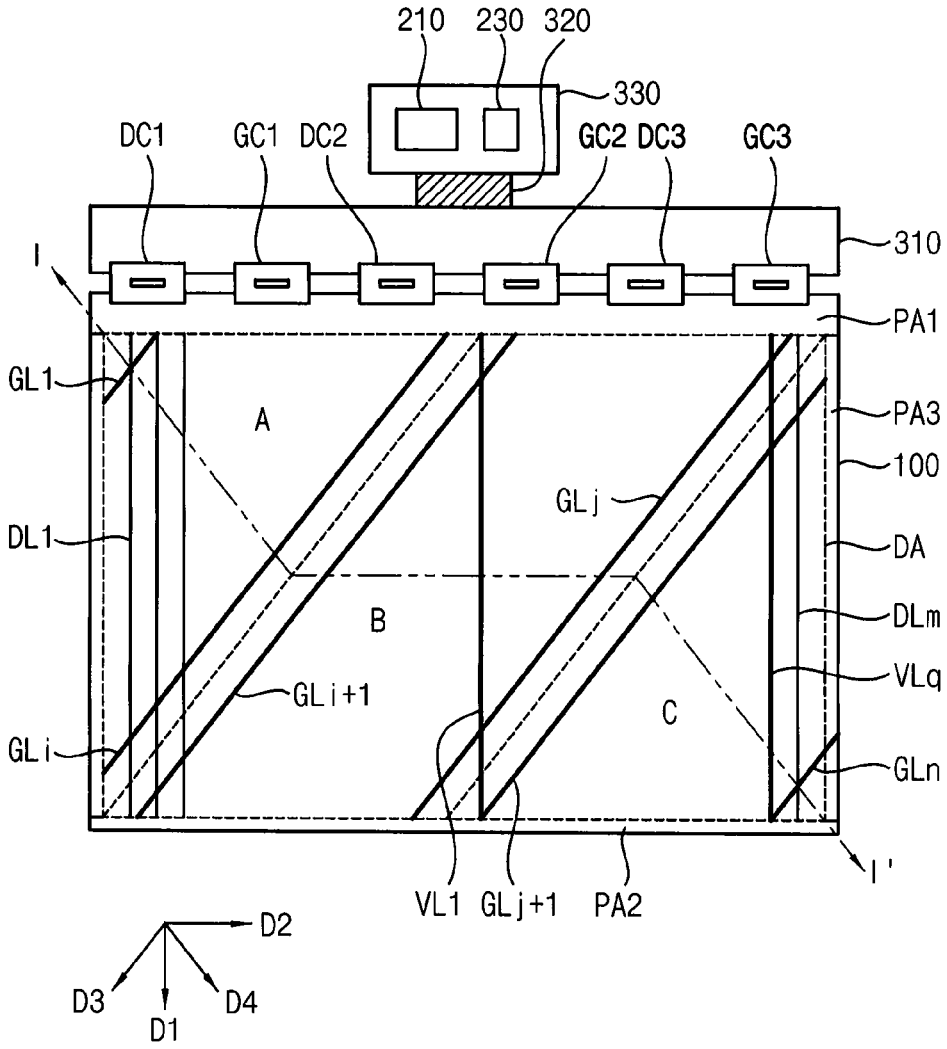
FIG. 1 is a plan view illustrating a display apparatus according to an exemplary embodiment.
Figure 2:
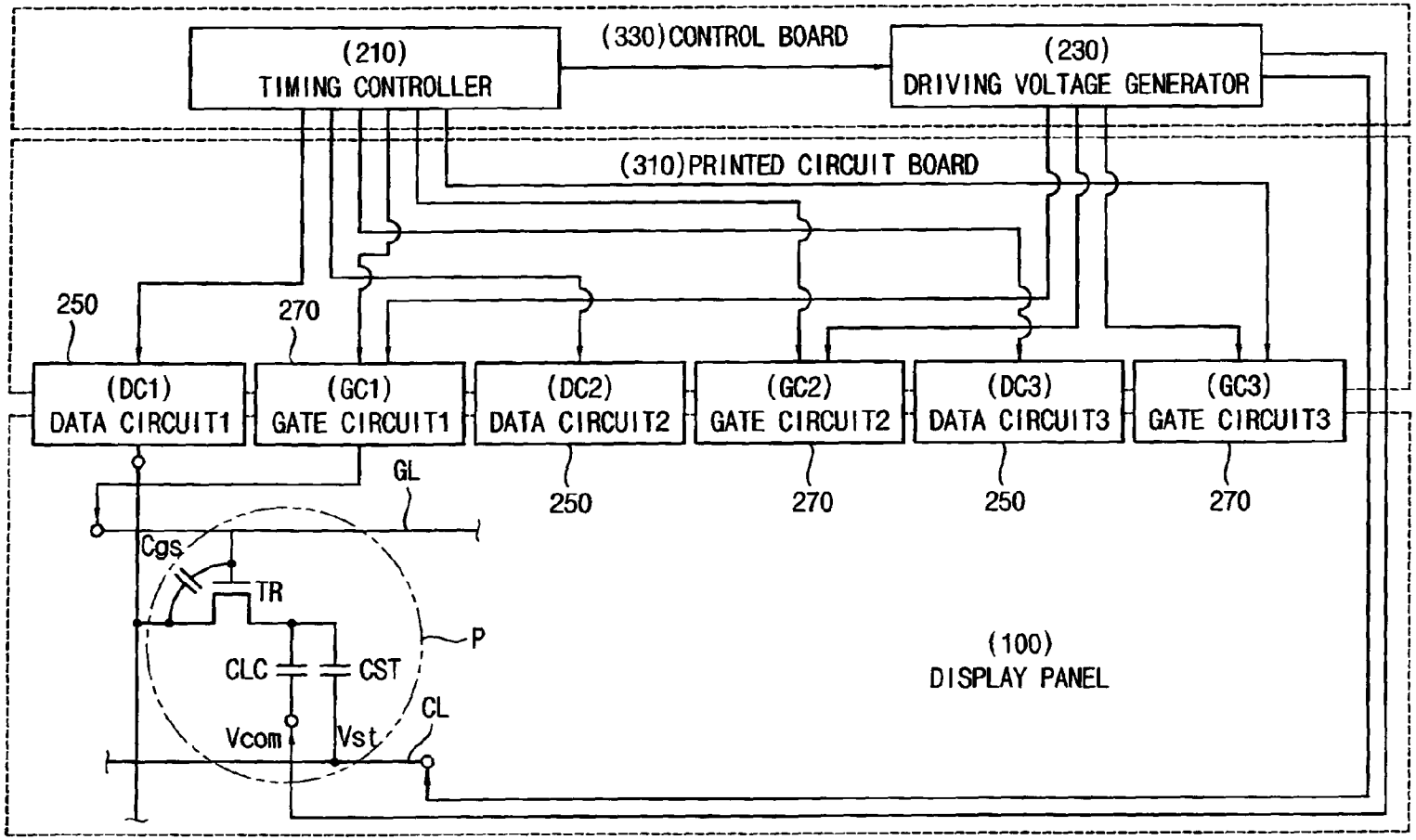
FIG. 2 is a block diagram illustrating a timing controller of FIG. 1.

FIG. 1 is a plan view illustrating a display apparatus according to an exemplary embodiment. FIG. 2 is a block diagram illustrating a timing controller of FIG. 1.

Referring to FIGS. 1 and 2, the display apparatus may include a display panel 100, a timing controller 210, a driving voltage generator 230, a data driver 250 and a gate driver 270.

The display panel 100 may include a display area DA displaying an image and a plurality of peripheral areas PA1 to PA4 surrounding the display area DA. The data driver 250 and the gate driver 270 are disposed in a first peripheral area PA1 of the peripheral areas.

The data driver 250 may include a plurality of data circuits DC1, DC2 and DC3. The gate driver 270 may include a plurality of gate circuits GC1, GC2 and GC3 which are disposed in the first peripheral area PA1 in which the data circuits DC1, DC2 and DC3 are disposed. The gate circuits GC1, GC2 and GC3 may be disposed between the data circuits DC1, DC2 and DC3.

The data driver 250 and the gate driver 270 are connected to the timing controller 210 and the driving voltage generator 230 which are disposed on a control board 330, through a printed circuit board 310 and a connection member 320.

The timing controller 210 is configured to receive an original control signal and an original data signal. The timing controller 210 is configured to generate a timing control signal which includes a data control signal and a gate control signal, using the original control signal. The data control signal controls a driving timing of the data driver 250 and includes a vertical synch signal, a horizontal synch signal, a data enable signal, a load signal, a dot clock signal and so on. The gate control signal controls a driving timing of the gate driver 270 and includes a vertical start signal, a gate clock signal, a gate enable signal and so on. The timing controller 210 is configured to correct the original data signal using various algorithms and to provide the data driver 250 with the corrected data signal.

The driving voltage generator 230 is configured to generate a plurality of driving voltages using an input voltage. The driving voltages includes an analog voltage applied to the data driver 250, a driving voltage applied to the gate the gate driver 270, a common voltage Vcom applied to the display panel 100 and a storage voltage Vst applied to the display panel 100. The gate driving voltage includes a gate-on voltage and a gate-off voltage.

The display panel 100 includes the display area DA in which a plurality of data lines DL1, . . . , DLm, a plurality of gate lines GL1, . . . , GLi, GLi+1, . . . , GLj, GLj+1, . . . , GLn, a plurality of vertical lines VL1, . . . , VLq and a plurality of pixels P are disposed. Wherein, i, j, n, m and q are natural numbers.

The data lines DL1, . . . , DLm extend in a first direction D1 and are arranged in a second direction D2 perpendicular to the first direction D1. End portions of the data lines DL1, . . . , DLm are connected to one of the data circuits DC1, DC2 and DC3 which are disposed in the first peripheral area PA1.

The gate lines GL1, . . . , GLi, GLi+1, . . . , GLj, GLj+1, . . . , GLn extend in a first diagonal direction D3 crossing the first and second directions D1, D2 and are arranged in a second diagonal direction D4 crossing the first diagonal direction D3.

According to the exemplary embodiment, the display area DA includes a first sub-area A, a second sub-area B and a third sub-area C which are divided in the second diagonal direction D4. The first sub-area A and the third sub-area C have a triangular shape and the second sub-area B has a trapezoid shape.

Thus, the gate lines GL1, . . . , GLi, GLi+1, . . . , GLj, GLj+1, . . . , GLn include a plurality of first gate lines GL1, . . . , GLi in the first sub-area A, a plurality of second gate lines GLi+1, . . . , GLj in the second sub-area B and a plurality of third gate lines GLj+1, . . . , GLn in the third sub-area C. Lengths of the first gate lines GL1, . . . , GLi gradually increase in a second diagonal direction D4, lengths of the second gate lines GLi+1, . . . , GLj are the same as each other, and lengths of the third gate lines GLj+1, . . . , GLn gradually decrease in the second diagonal direction D4.

End portions of the first gate lines GL1, . . . , GLi are connected to one of the gate circuits GC1, GC2 and GC3 which are disposed in the first peripheral area PA1.

End portions of the second gate lines GLi+1, . . . , GLj are connected to one of the gate circuits GC1, GC2 and GC3 which are disposed in the first peripheral area PA1.

However, first end portions of the third gate lines GLj+1, . . . , GLn are adjacent to a second peripheral area PA2 which is opposite to the first peripheral area PA1 and second end portions of the third gate lines GLj+1, . . . , GLn are adjacent to a third peripheral area PA3 which connects the first and second peripheral areas PA1 and PA2. Thus, the third gate lines GLj+1, . . . , GLn are connected to the plurality of vertical lines VL1, . . . , VLq in order to connect with the gate circuits GC1, GC2 and GC3 which are disposed in the first peripheral area PA1.

The vertical lines VL1, . . . , VLq extend in the first direction D1 and are arranged in the second direction D2. First end portions of the vertical lines VL1, . . . , VLq are connected to the third gate lines GLj+1, . . . , GLn in the second peripheral area PA2. Second end portions of the vertical lines VL1, . . . , VLq are connected to one of the gate circuits GC1, GC2 and GC3 which are disposed in the first peripheral area PA1. The vertical lines VL1, . . . , VLq transfer gate signals to the third gate lines GLj+1, . . . , GLn.

Thus, the gate signals applied to the third gate lines GLj+1, . . . , GLn is delayed by an RC time delay of the vertical lines VL1, . . . , VLq from the gate signals applied to the first and second gate lines GL1, . . . , GLi, GLi+1, . . . , GLj.

As shown in FIG. 2, each of the pixels P includes a switching element TR, a liquid crystal capacitor CLC and a storage capacitor CST.

The switching element TR includes a gate electrode connected to a gate line GL1, a source electrode connected to a data line DL and a drain electrode connected to a first end portion of the liquid crystal capacitor CLC corresponding to a pixel electrode. A second end portion of the liquid crystal capacitor CLC receives a common voltage VCOM. The common voltage VCOM is applied to a common electrode overlapping the pixel electrode. The storage capacitor CST includes a first end portion connected to the liquid crystal capacitor CLC and a second end portion receiving a storage common voltage VST. The first end portion of the storage capacitor CST corresponds to the pixel electrode and the storage common voltage VST is transferred through the storage line SL in the display area DA. The liquid crystal capacitor CLC may be defined by the pixel electrode, the common electrode and a liquid crystal layer between the pixel electrode and the common electrode. The storage capacitor CST may be defined by the pixel electrode, the storage electrode and an insulating layer between the pixel electrode and the storage electrode.

According to the exemplary embodiment, the timing controller 210 is configured to control a level of a gate-on voltage applied to at least one of the first, second and third sub-areas A, B and C of the display area DA to be different from a reference level such that a kickback voltage difference between the first, second and third sub-areas A, B and C by the RC time delay may be reduced. The reference level is a normal level of the gate-on voltage.

In addition, according to an exemplary embodiment, the timing controller 210 is configured to control a slice value of a gate signal applied to at least one of the first, second and third sub-areas A, B and C of the display area DA to be different from a reference slice value such that a kickback voltage difference between the first, second and third sub-areas A, B and C by the RC time delay may be reduced. The reference slice value is a normal slice value preset based on an RC time delay of the gate signal.

In addition, according an exemplary embodiment, a source/gate capacitance or a storage capacitance formed in at least one of the first, second and third sub-areas A, B and C may be designed different from each other such that a kickback voltage difference between the first, second and third sub-areas A, B and C by the RC time delay may be reduced.

In addition, according to an exemplary embodiment, an additional load may be added to the gate lines or the storage lines disposed in at least one of the first, second and third sub-areas A, B and C such that a kickback voltage difference between the first, second and third sub-areas A, B and C by the RC time delay may be reduced.

As described above, according to the exemplary embodiments, a kickback voltage difference between the first, second and third sub-areas A, B and C by the RC time delay may be reduced and thus, a luminance difference of the display area DA may be reduced.

Figure 3:
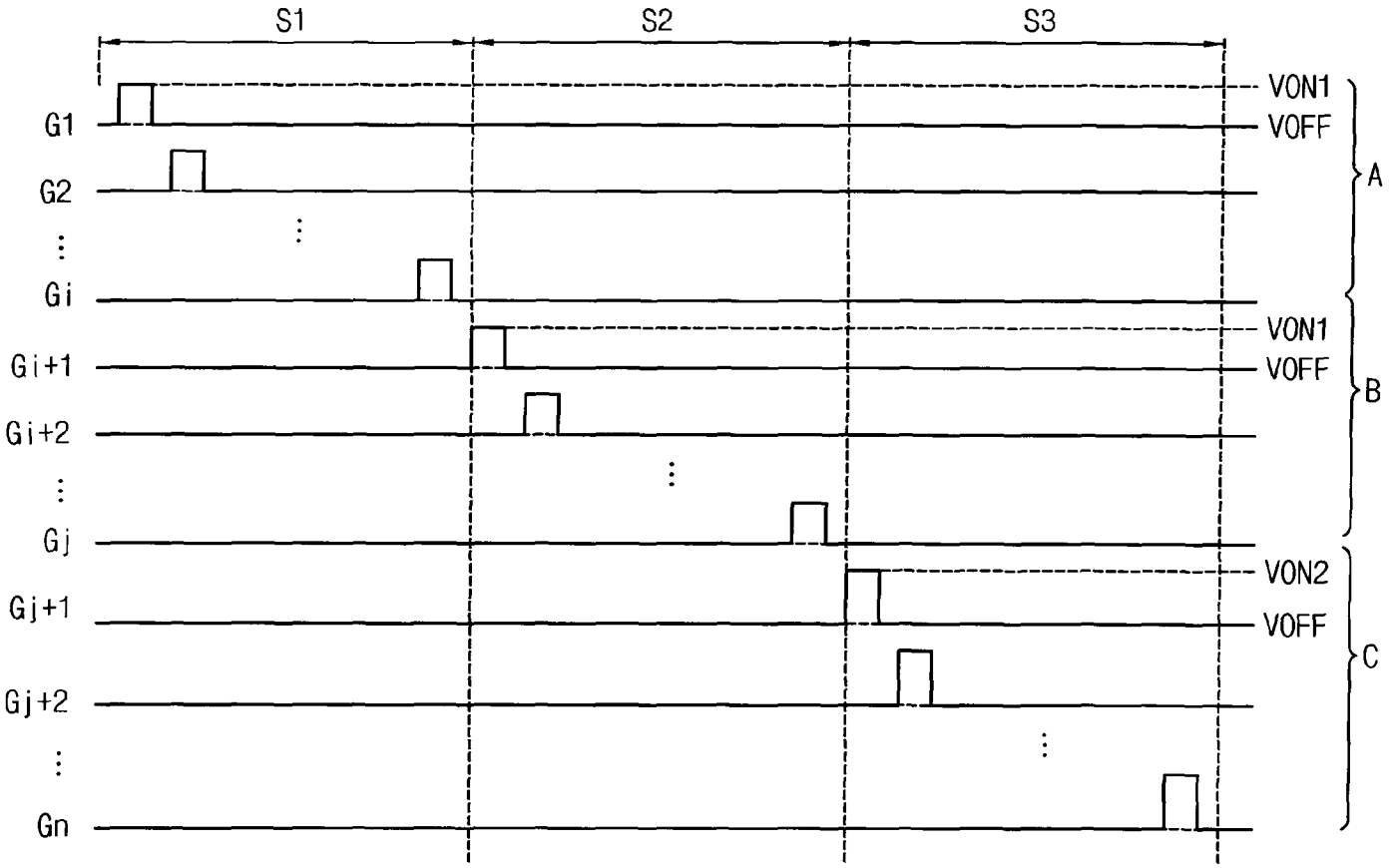
FIG. 3 is a waveform diagram illustrating a method of driving a display apparatus according to an exemplary embodiment.
Figure 4:
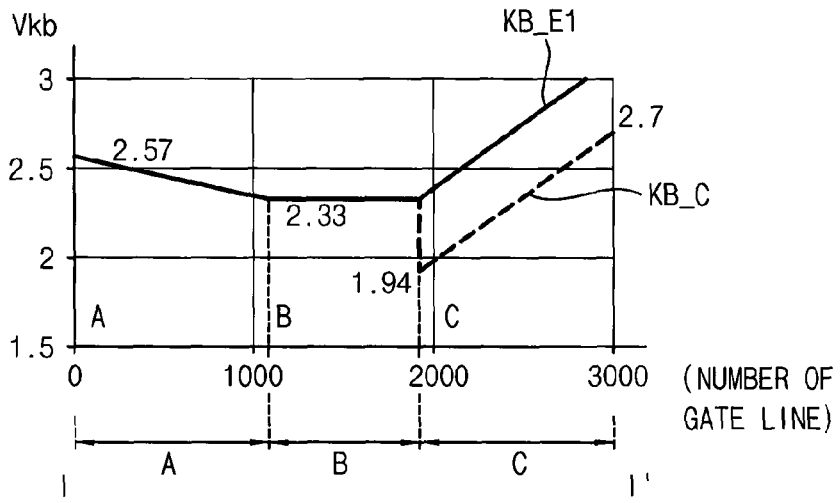
FIG. 4 is a graph diagrams illustrating a kickback voltage along a I-I' line of FIG. 1 according to the method of FIG. 2.

FIG. 3 is a waveform diagram illustrating a method of driving a display apparatus according to an exemplary embodiment. FIG. 4 is a graph diagrams illustrating a kickback voltage along a I-I' line of FIG. 1 according to the method of FIG. 2

Referring to FIGS. 2 and 3, the gate driver 270 is configured to generate a plurality of gate signals based on a control of the timing controller 210, and to sequentially provide the plurality of gate lines GL1, . . . , GLi, GLi+1, . . . , GLj, GLj+1, . . . , GLn with the gate signals.

For example, the gate driver 270 is configured to provide the first and second gate lines GL1, . . . , GLi, GLi+1, . . . , GLj in the first and second sub-areas A and B with the gate signals, and to provide the third gate lines GLj+1, . . . , GLn in the third sub-area C with gate signals having a gate-on voltage different from the gate signals applied to the first and second gate lines GL1, . . . , GLi, GLi+1, . . . , GLj.

For example, the gate driver 270 is configured to sequentially provide the first and second gate lines GL1, . . . , GLi, GLi+1, . . . , GLj with the gate signals having a first gate-on voltage VON1 during first and second periods S1 and S2 respectively corresponding to the first and second sub-areas A and B and to sequentially provide the third gate lines GLj+1, . . . , GLn with the gate signals having a second gate-on voltage VON2 being higher than the first gate-on voltage VON1 during a third sub period S3 corresponding to the third sub-area C. The first gate-on voltage is a normal gate-on voltage corresponding to a reference gate-on voltage, and the second gate-on voltage is higher than the reference gate-on voltage.

The gate signals are applied to the third gate lines GLj+1, . . . , GLn in the third sub-area C through the vertical lines VL1, . . . , VLq and thus, the gate signals applied to the third gate lines GLj+1, . . . , GLn are delayed by a absolute RC time delay from the gate signals applied to the first and second gate lines GL1, . . . , GLi, GLi+1, . . . , GLj in the first and second sub-areas A and B.

According to the exemplary embodiment, in order that the RC time delay of the third sub-area C may be compensated, the second gate-on voltage VON2 applied to the third gate lines GLj+1, . . . , GLn is higher than the first gate-on voltage VON1 applied to the first and second gate lines GL1, . . . , GLi, GLi+1, . . . , GLj.

Referring to FIG. 4, according to a comparative example embodiment, a method of driving the display panel includes sequentially providing gate lines GL1, . . . , GLi, GLi+1, . . . , GLj, GLj+1, . . . , GLn in first to third sub-areas A, B and C with a normal gate signal which has a reference gate-on voltage and a reference slice value. A kickback voltage KB_C of the display panel according to the comparative example embodiment gradually decreases in the first sub-area A, maintains a constant level in the second sub-area B, sharply decreases in a boundary area between the second sub-area B and the third sub-area C and then, gradually increases in the third sub-area C. In the case comparative example embodiment, the kickback voltage KB_C sharply decreases in the boundary area between the second and third sub-areas B and C, and thus, a luminance difference may be observed in the boundary area that is a discontinuous area.

However, according to a method of driving the display panel of the exemplary embodiment as shown in FIG. 3, a kickback voltage KB_E1 gradually decreases in the first sub-area A, maintains a constant level in the second sub-area B, and gradually increases in the third sub-area C. In the exemplary embodiment, the gate-on voltage applied to the third gate lines GLj+1, . . . , GLn is highly determined based on the kickback voltage in the third sub-area C and thus, the kickback voltage KB_E1 is continuously changed in the boundary area between the second and third sub-areas B and C. Thus, a luminance difference may be not observed in the boundary area.

According to the exemplary embodiment, the gate-on voltage applied to the first and second sub-areas A and B is determined into a reference gate-on voltage and the gate-on voltage applied to the third sub-area C is determined into a gate-on voltage being higher than the reference gate-on voltage and thus, the kickback voltage in the boundary area between the first, second and third sub-areas A, B and C may be continuously changed. Thus, the luminance difference of the display panel may be reduced.

Figure 5:
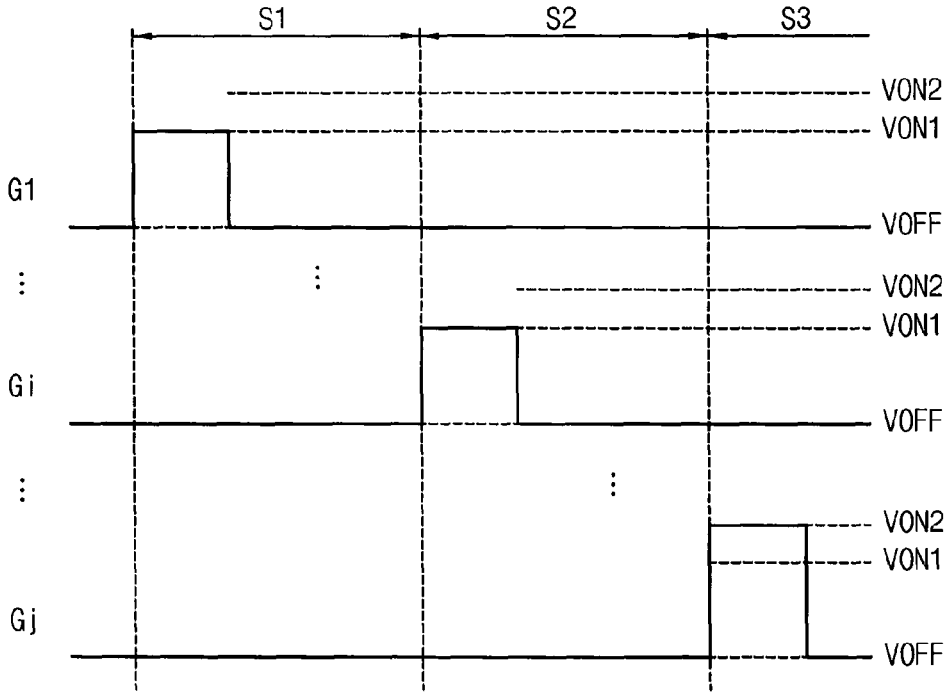
FIG. 5 is a waveform diagram illustrating a method of driving a display apparatus according to an exemplary embodiment.
Figure 6:
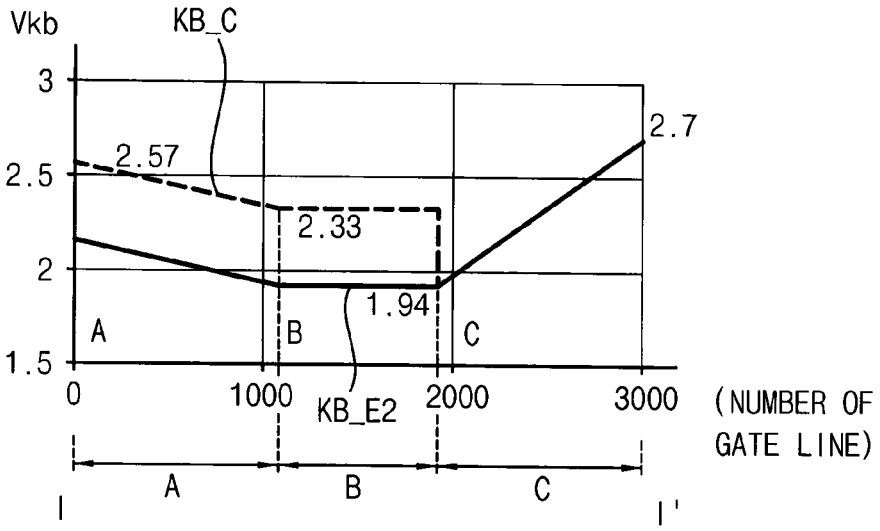
FIG. 6 is a graph diagrams illustrating a kickback voltage along a I-I' line of FIG. 1 according to the method of FIG. 5.

FIG. 5 is a waveform diagram illustrating a method of driving a display apparatus according to an exemplary embodiment. FIG. 6 is a graph diagrams illustrating a kickback voltage along an I-I' line of FIG. 1 according to the method of FIG. 5.

Referring to FIGS. 2 and 5, the gate driver 270 is configured to generate a plurality of gate signals based on a control of the timing controller 210 and to sequentially provide the plurality of gate lines GL1, . . . , GLi, GLi+1, . . . , GLj, GLj+1, . . . , GLn with the plurality of gate signals.

The gate driver 270 is configured to provide the first and second gate lines GLi, . . . , GLi, GLi+1, . . . , GLj in the first and second sub-areas A and B with the gate signals, and to provide the third gate lines GLj+1, . . . , GLn in the third sub-area C with gate signals having a gate-on voltage different from the gate signals applied to the first and second gate lines GL1, . . . , GLi, GLi+1, . . . , GLj.

For example, the gate driver 270 is configured to sequentially provide the first and second gate lines GL1, . . . , GLi, GLi+1, . . . , GLj with the gate signals having a first gate-on voltage VON1 during first and second periods S1 and S2 respectively corresponding to the first and second sub-areas A and B and to sequentially provide the third gate lines GLj+1, . . . , GLn with the gate signals having a second gate-on voltage VON2 being higher than the first gate-on voltage VON1 during a third sub period S3 corresponding to the third sub-area C.

The first gate-on voltage VON1 applied to first and second gate lines GL1, . . . , GLi, GLi+1, . . . , GLj is lower than the reference gate-on voltage and the second gate-on voltage VON2 is the same as the reference gate-on voltage.

According to the exemplary embodiment, in order that the RC time delay of the third sub-area C may be compensated, the first gate-on voltage VON1 applied to the first and second gate lines GL1, . . . , GLi, GLi+1, . . . , GLj is lower than the reference gate-on voltage that is the second gate-on voltage VON2 applied to the third gate lines GLj+1, . . . , GLn.

Referring to FIG. 6, according to a comparative example embodiment, a method of driving the display panel includes sequentially providing gate lines GL1, . . . , GLi, GLi+1, . . . , GLj, GLj+1, . . . , GLn in first to third sub-areas A, B and C with a normal gate signal which has a reference gate-on voltage and a reference slice value. A kickback voltage KB_C of the display panel according to the comparative example embodiment gradually decreases in the first sub-area A, maintains a constant level in the second area B, sharply decreases in a boundary area between the second sub-area B and the third sub-area C and then, gradually increases in the third sub-area C. In the case comparative example embodiment, the kickback voltage KB_C sharply decreases in the boundary area between the second and third sub-areas B and C, and thus, a luminance difference may be observed in the boundary area that is a discontinuous area.

However, according to a method of driving the display panel of the exemplary embodiment as shown in FIG. 5, a kickback voltage KB_E2 being lower than the kickback voltage KB_C gradually decreases in the first sub-area A and maintains a constant level being lower than the kickback voltage KB_C in the second sub-area B. And then, the kickback voltage KB_E2 gradually increases in the third sub-area C such as the kickback voltage KB_C.

In the exemplary embodiment, the kickback voltage KB_E2 gradually decreases in the first sub-area A, maintains a constant level in the second sub-area B, and gradually increases in the third sub-area C. Thus, a luminance difference may be not observed in the boundary area between the second and third sub-areas B and C in comparison with the kickback voltage KB_C of the comparative example embodiment.

According to the exemplary embodiment, the gate-on voltage applied to the third sub-area C is determined into a reference gate-on voltage and the gate-on voltage applied to the first and second sub-areas A and B is determined into a gate-on voltage being higher than the reference gate-on voltage and thus, a kickback voltage in the boundary area between the first, second and third sub-areas A, B and C may be continuously changed. Thus, the luminance difference of the display panel may be reduced.

Figure 7:
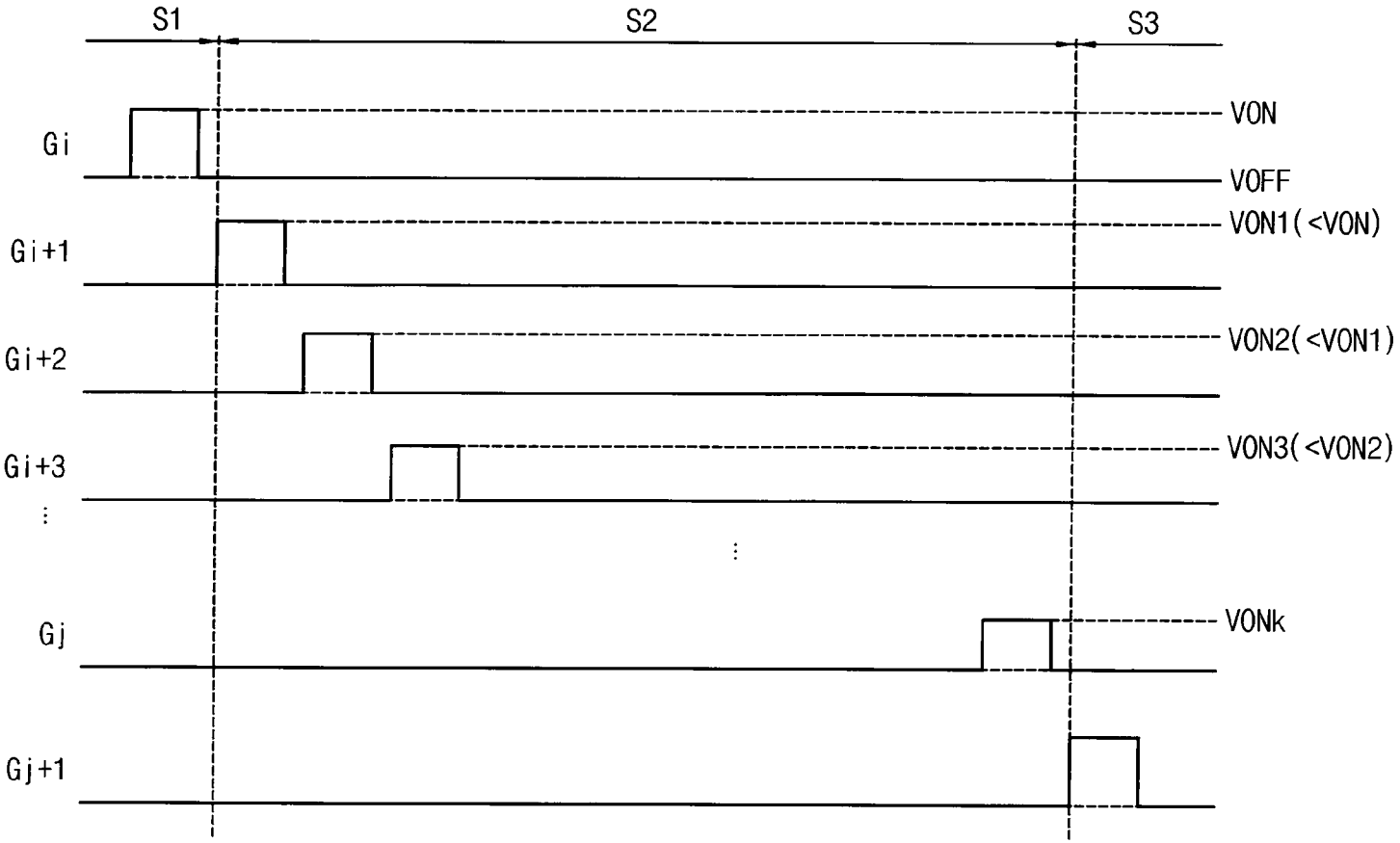
FIG. 7 is a waveform diagram illustrating a method of driving a display apparatus according to an exemplary embodiment.
Figure 8:
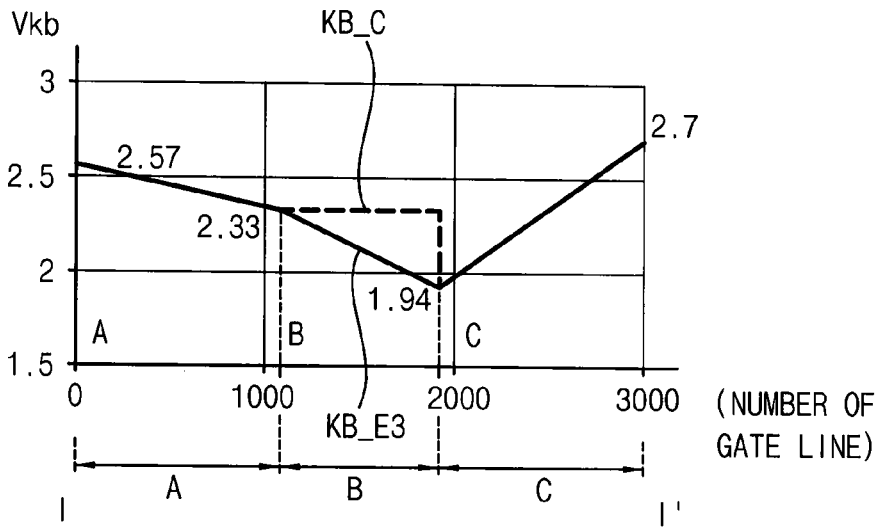
FIG. 8 is a graph diagrams illustrating a kickback voltage along a I-I' line of FIG. 1 according to the method of FIG. 7.

FIG. 7 is a waveform diagram illustrating a method of driving a display apparatus according to an exemplary embodiment. FIG. 8 is a graph diagrams illustrating a kickback voltage along an I-I' line of FIG. 1 according to the method of FIG. 7.

Referring to FIGS. 2 and 7, the gate driver 270 is configured to generate a plurality of gate signals based on a control of the timing controller 210 and to sequentially provide the plurality of gate lines GL1, . . . , GLi, GLi+1, . . . , GLj, GLj+1, . . . , GLn with the plurality of gate signals.

For example, the gate driver 270 is configured to sequentially provide the first gate lines GL1, . . . , GLi in the first sub-area A with a plurality of gate signals having a reference gate-on voltage VON during a first sub period S1 of a frame period.

The gate driver 270 is configured to sequentially provide the second gate lines GLi+1, . . . , GLj in the second sub-area B with a plurality of gate signals Gi+1, Gi+2, Gi+3, . . . , Gj having a plurality of gate-on voltages VON1, VON2, VON3, . . . , VONk which is lower than the reference gate-on voltage during a second sub period S2 of the frame period. The gate-on voltages VON1, VON2, VON3, . . . , VONk gradually decrease.

The gate driver 270 is configured to sequentially provide the third gate lines GLj+1, . . . , GLn in the third sub-area C with a plurality of gate signals having the reference gate-on voltage VON during a third sub period S3 of the frame period.

According to the exemplary embodiment, the gate-on voltages VON1, VON2, VON3, . . . , VONk applied to the second gate lines GLi+1, . . . , GLj in the second sub-area B are lower than the reference gate-on voltage and gradually decrease.

Referring to FIG. 8, according to a comparative example embodiment, a method of driving the display panel includes sequentially providing gate lines GL1, . . . , GLi, GLi+1, . . . , GLj, GLj+1, . . . , GLn in first to third sub-areas A, B and C with a normal gate signal which has a reference gate-on voltage and a reference slice value. A kickback voltage KB_C of the display panel according to the comparative example embodiment gradually decreases in the first sub-area A, maintains a constant level in the second sub-area B, sharply decreases in a boundary area between the second sub-area B and the third sub-area C and then, gradually increases in the third sub-area C. In the case comparative example embodiment, the kickback voltage KB_C sharply decreases in the boundary area between the second and third sub-areas B and C, and thus, a luminance difference may be observed in the boundary area that is a discontinuous area.

However, in comparison with the kickback voltage KB_C of the comparative example embodiment, a kickback voltage KB_E3 according to a method of driving the display panel of the exemplary embodiment as shown in FIG. 7, is substantially the same in the first and third sub-areas A and C. On the other hand, the kickback voltage KB_E3 in the second sub-area B gradually decreases from a kickback voltage in a boundary area between the first and second sub-areas A and B, to a kickback voltage in a boundary area between the second and third sub-areas B and C.

According to the exemplary embodiment, the kickback voltage KB_E3 gradually decreases in the first sub-area A, gradually decreases in the second sub-area B, and gradually increases in the third sub-area C. Thus, a luminance difference may be not observed in the boundary area between the second and third sub-areas B and C in comparison with the kickback voltage KB_C of the comparative example embodiment.

According to the exemplary embodiment, the gate signals Gi+1, Gi+2, Gi+3, . . . , Gj having the gate-on voltages VON1, VON2, VON3, . . . , VONk which are lower than the reference gate-on voltage and gradually decrease, are applied to the second gate lines GLi+1, . . . , GLj in the second sub-area B and thus, a kickback voltage in the boundary area between the first, second and third sub-areas A, B and C may be continuously changed. Thus, the luminance difference of the display panel may be reduced.

Figure 9:
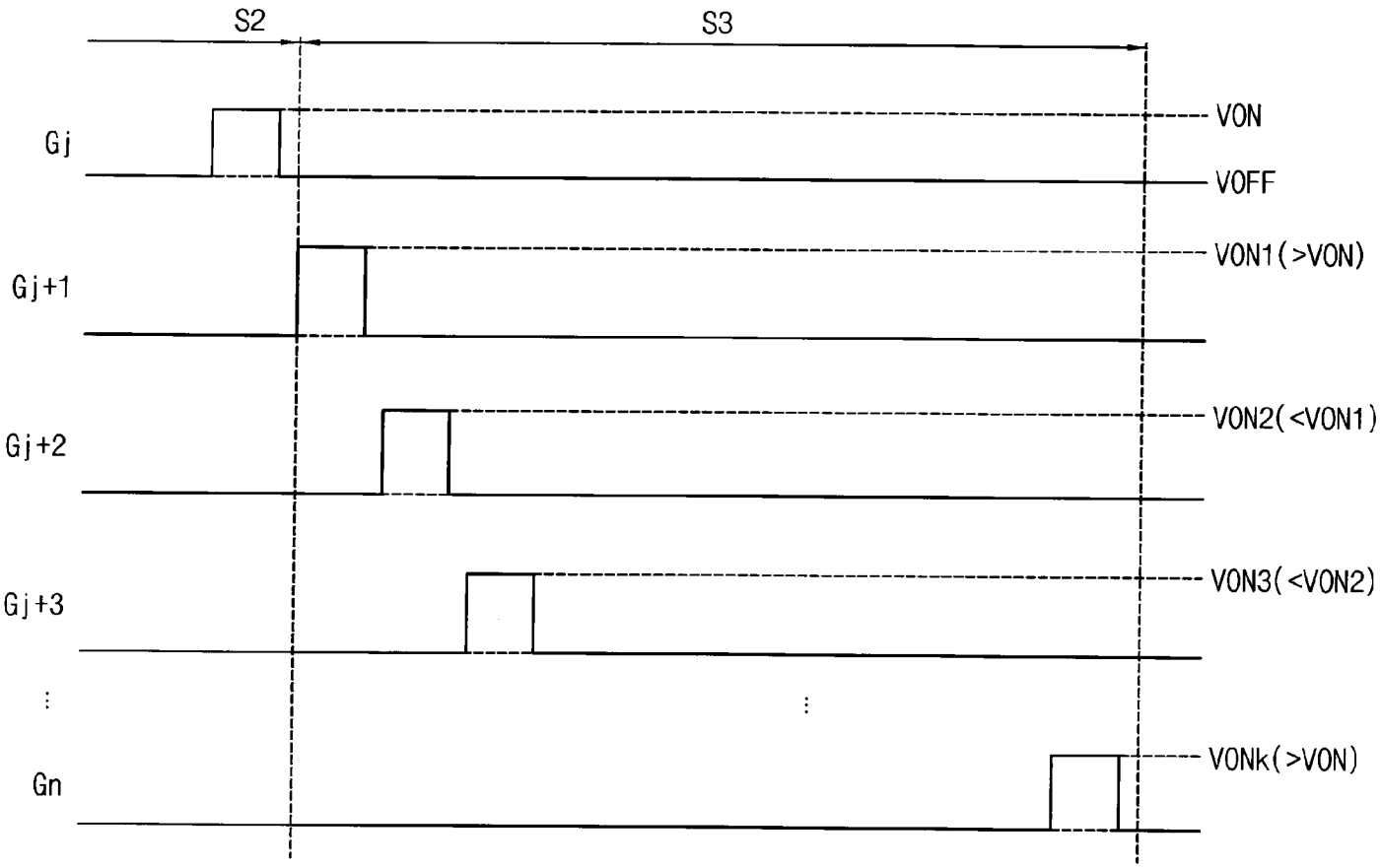
FIG. 9 is a waveform diagram illustrating a method of driving a display apparatus according to an exemplary embodiment.
Figure 10:
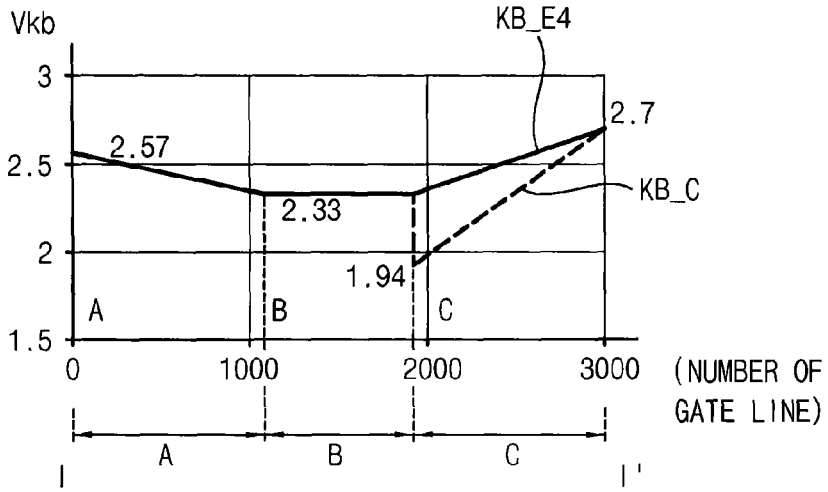
FIG. 10 is a graph diagrams illustrating a kickback voltage along a I-I' line of FIG. 1 according to the method of FIG. 9.

FIG. 9 is a waveform diagram illustrating a method of driving a display apparatus according to an exemplary embodiment. FIG. 10 is a graph diagrams illustrating a kickback voltage along an I-I' line of FIG. 1.

Referring to FIGS. 2 and 9, the gate driver 270 is configured to generate a plurality of gate signals based on a control of the timing controller 210 and to sequentially provide the plurality of gate lines GL1, . . . , GLi, GLi+1, . . . , GLj, GLj+1, . . . , GLn with the plurality of gate signals.

For example, the gate driver 270 is configured to sequentially provide the first gate lines GL1, . . . , GLi in the first sub-area A with a plurality of gate signals having a reference gate-on voltage VON during a first sub period S1 of a frame period.

The gate driver 270 is configured to sequentially provide the second gate lines GLi+1, . . . , GLj in the second sub-area B with a plurality of gate signals having a reference gate-on voltage VON during a second sub period S2 of the frame period.

The gate driver 270 is configured to sequentially provide the third gate lines GLj+1, . . . , GLn in, the third sub-area C with a plurality of gate signals Gj+1, Gj+2, Gj+3, . . . , Gn having a plurality of gate-on voltages VON1, VON2, VON3, . . . , VONk which is higher than the reference gate-on voltage during a third sub period S3 of the frame period. The gate-on voltages VON1, VON2, VON3, . . . , VONk gradually decrease. A last gate-on voltage VONk among the gate-on voltages VON1, VON2, VON3, . . . , VONk has a gate-on voltage being higher than the reference gate-on voltage VON.

According to the exemplary embodiment, the gate signals Gj+1, Gj+2, Gj+3, . . . , Gn having the gate-on voltages VON1, VON2, VON3, . . . , VONk are applied to the third gate lines GLj+1, . . . , GLn in the third sub-area C. The gate-on voltages VON1, VON2, VON3, . . . , VONk are higher than the reference gate-on voltage and gradually decrease.

Referring to FIG. 10, according to a comparative example embodiment, a method of driving the display panel includes sequentially providing gate lines GL1, . . . , GLi, GLi+1, . . . , GLj, GLj+1, . . . , GLn in first to third sub-areas A, B and C with a normal gate signal which has a reference gate-on voltage and a reference slice value. A kickback voltage KB_C of the display panel according to the comparative example embodiment gradually decreases in the first sub-area A, maintains a constant level in the second sub-area B, sharply decreases in a boundary area between the second sub-area B and the third sub-area C and then, gradually increases in the third sub-area C. In the case comparative example embodiment, the kickback voltage KB_C sharply decreases in the boundary area between the second and third sub-areas B and C, and thus, a luminance difference may be observed in the boundary area that is a discontinuous area.

However, in comparison with the kickback voltage KB_C of the comparative example embodiment, a kickback voltage KB_E4 according to a method of driving the display panel of the exemplary embodiment as shown in FIG. 9, is substantially the same in the first and third sub-areas A and C. On the other hand, the kickback voltage KB_E4 in the third sub-area C gradually increases from a kickback voltage in a boundary area between the second and third sub-areas B and C, to a last area of the third sub-area C.

According to the exemplary embodiment, the kickback voltage KB_E4 gradually decreases in the first sub-area A, maintains a constant level in the second sub-area B, and gradually increases in the third sub-area C. Thus, a luminance difference may be not observed in the boundary area between the second and third sub-areas B and C in comparison with the kickback voltage KB_C of the comparative example embodiment.

According to the exemplary embodiment, the gate signals Gj+1, Gj+2, Gj+3, . . . , Gn having the gate-on voltages VON1, VON2, VON3, . . . , VONk which are higher than the reference gate-on voltage and gradually decrease, are applied to third gate lines GLj+1, . . . , GLn in the third sub-area C and thus, a kickback voltage in the boundary area between the first, second and third sub-areas A, B and C may be continuously changed. Thus, the luminance difference of the display panel may be reduced.

Figure 11:
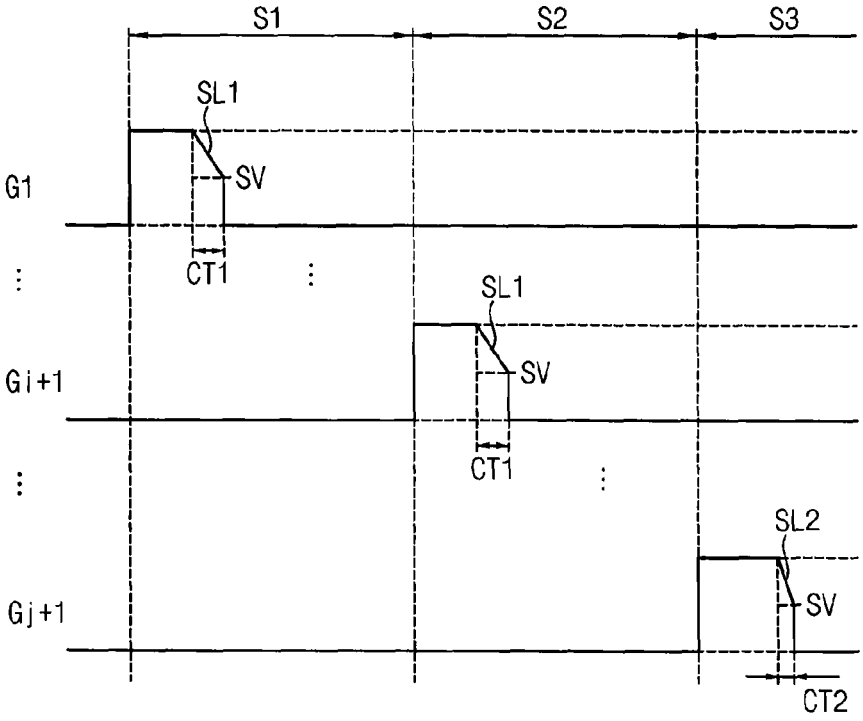
FIG. 11 is a waveform diagram illustrating a method of driving a display apparatus according to an exemplary embodiment.

FIG. 11 is a waveform diagram illustrating a method of driving a display apparatus according to an exemplary embodiment.

Referring to FIGS. 2 and 11, the gate driver 270 is configured to generate a plurality of gate signals based on a control of the timing controller 210 and to sequentially provide the plurality of gate lines GL1, . . . , GLi, GLi+1, . . . , GLj, GLj+1, . . . , GLn with the plurality of gate signals.

The gate driver 270 is configured to sequentially provide the first gate lines GL1, . . . , GLi in the first sub-area A with a plurality of gate signals having a first slice value SL during a first sub period S1 of a frame period. The first slice value SL1 has a first charge sharing period CT1 and a charge sharing voltage SV. The first slice value SL1 is the same as a reference slice value which is determined based on an RC time delay of a gate signal applied to the first sub-area A.

The gate driver 270 is configured to sequentially provide the second gate lines GLi-+1, . . . , GLj in the second sub-area B with a plurality of gate signals having the first slice value SL1 during a second sub period S2 of the frame period.

The gate driver 270 is configured to sequentially provide the third gate lines GLj+1, . . . , GLn in the third sub-area C with a plurality of gate signals having a second slice value SL2 during a third sub period S3 of the frame period. The second slice value SL2 is smaller than a reference slice value which is determined based on an RC time delay of a gate signal applied to the third sub-area C.

The second slice value SL2 may have a second charge sharing period CT2 less than the first charge sharing period CT1 and the charge sharing voltage SV. Herein, the first and second slice values SL1 and SL2 have charge sharing periods different each other, but mot limited thereto. The first and second slice values SL1 and SL2 may have charge sharing voltages different each other. Alternatively, the first and second slice values SL1 and SL2 may have charge sharing periods different each other and charge sharing voltages different each other.

Generally, when the slice value of the gate signal increases the kickback voltage decreases and when the slice value of the gate signal decreases the kickback voltage increases. Thus, when the slice value of the gate signals applied to the third gate lines GLj+1, . . . , GLn in the third sub-area C is smaller than the reference slice value and gradually decrease, the kickback voltage in the third sub-area C may be larger than a reference kickback voltage and gradually increases.

According the exemplary embodiment, as shown in FIG. 4, the kickback voltage kickback voltage KB_E1 is more than the kickback voltage KB_C of the comparative example embodiment and gradually increases without a discontinuous area, in the boundary area between the second and third sub-areas B and C.

Therefore, the kickback voltage KB_E1 gradually decreases in the first sub-area A, maintains a constant level in the second sub-area B, and gradually increases in the third sub-area C. Thus, a luminance difference may be not observed in the boundary area between the second and third sub-areas B and C.

Alternatively, although not shown in figures, the slice values of the gate signals applied to the first and second gate lines GL1, . . . , GLi, GLi+1, . . . , GLj in the first and second sub-area A and B may be determined to be larger than the reference slice value and to gradually increase. And then, the slice values of the gate signals applied to the third gate lines GLj+1, . . . , GLn in the third sub-area C may be determined to be a reference slice value. In this case, as the exemplary embodiment shown in FIG. 6, the kickback voltage KB_E2 decreases by a constant level with respect to the kickback voltage KB_C of the comparative example embodiment in the first and second sub-areas A and B.

Therefore, the kickback voltage KB_E2 gradually decreases in the first sub-area A, maintains a constant level in the second sub-area B, and gradually increases in the third sub-area C without a discontinuous area. Thus, a luminance difference may be not observed in the boundary area between the second and third sub-areas B and C.

Figure 12:
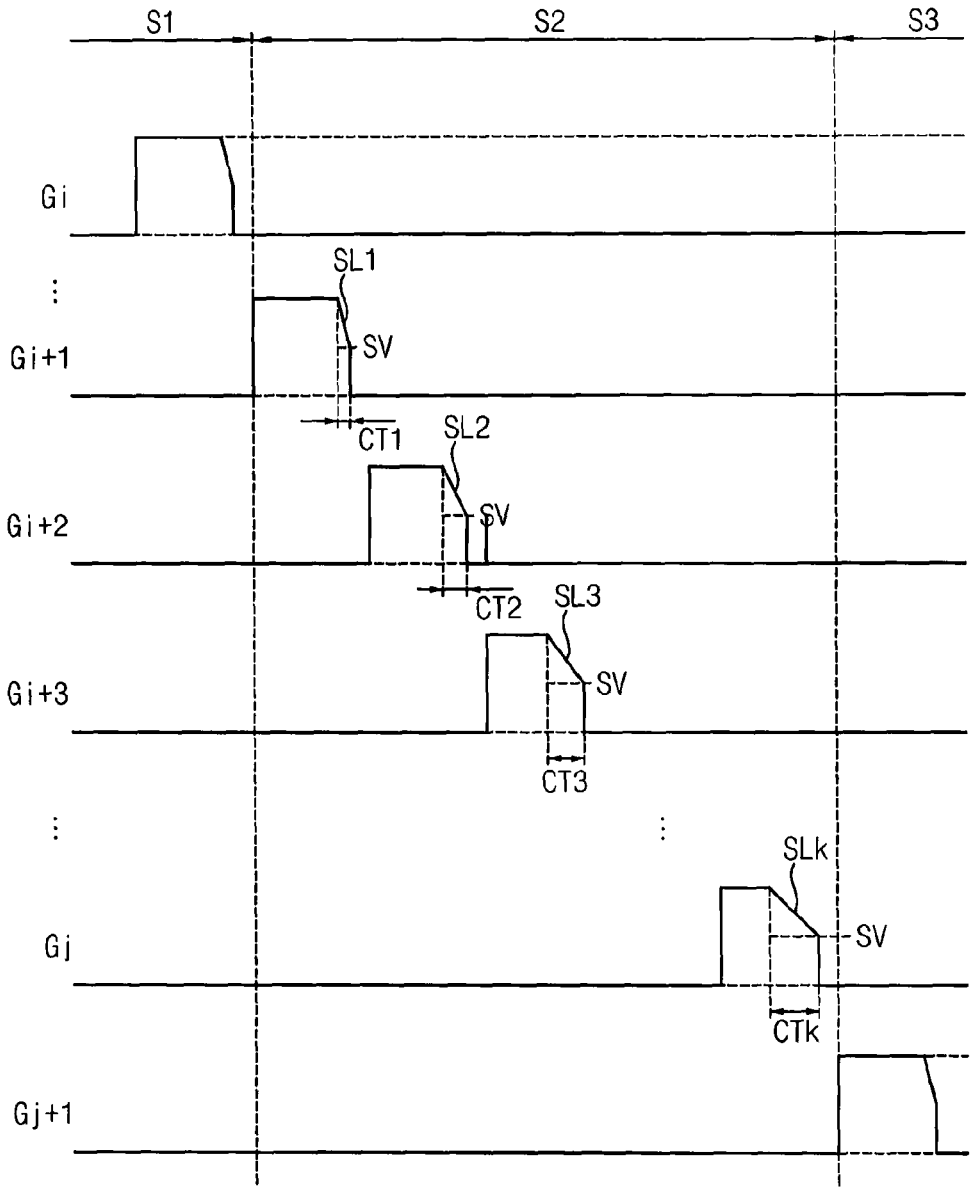
FIG. 12 is a waveform diagram illustrating a method of driving a display apparatus according to an exemplary embodiment.

FIG. 12 is a waveform diagram illustrating a method of driving a display apparatus according to an exemplary embodiment.

Referring to FIGS. 2 and 12, the gate driver 270 is configured to generate a plurality of gate signals based on a control of the timing controller 210 and to sequentially provide the plurality of gate lines GL1, . . . , GLi, GLi+1, . . . , GLj, GLj+1, . . . , GLn with the plurality of gate signals.

The gate driver 270 is configured to sequentially provide the first gate lines GL1, . . . , GLi in the first sub-area A with a plurality of gate signals G1, . . . , Gi during a first sub period S1 of a frame period. The gate signals G1, . . . , Gi applied to the first gate lines GL1, . . . , GLi have a reference slice value which is determined based on an RC time delay of a gate signal applied to the first sub-area A.

The gate driver 270 is configured to sequentially provide the second gate lines GLi+1, . . . , GLj in the second sub-area B with a plurality of gate signals Gi+1, Gi+2, Gi+3, . . . , Gj having a plurality of slice values SL1, SL2, SL3, . . . , SLk during a second sub period S2 of the frame period. The plurality of slice values SL1, SL2, SL3, . . . , SLk are lager than a reference slice value which is determined based on an RC time delay of a gate signal applied to the second sub-area B, and gradually increase. Wherein, k is a natural number.

The slice value is determined by a charge sharing period and a charge sharing voltage. The slice values SL1, SL2, SL3, . . . , SLk have charge sharing periods CT1, CT2, CT3, . . . , CTk which gradually increase, and charge sharing voltages SV being the same as each other. As shown in FIG. 12, the slice values SL1, SL2, SL3, . . . , SLk may be determined by gradually increasing the charge sharing periods CT1, CT2, CT3, . . . , CTk, but not limited thereto. The slice values SL1, SL2, SL3, . . . , SLk may be determined by controlling the charge sharing voltages. Alternatively, the slice values SL1, SL2, SL3, . . . , SLk may be determined by controlling all the charge sharing periods and the charge sharing voltages.

The gate driver 270 is configured to sequentially provide the third gate lines GLj+1, . . . , GLn in the third sub-area C with a plurality of gate signals G1, . . . , Gi during third sub period S3 of the frame period. The gate signals applied to the third gate lines GLj+1, . . . , GLn have a reference slice value which is determined based on an RC time delay of a gate signal applied to the third sub-area C.

Generally, when the slice value of the gate signal increases the kickback voltage decreases and when the slice value of the gate signal decreases the kickback voltage increases. Thus, when the slice value of the gate signals applied to the second gate lines GLi+1, . . . , GLj in the second sub-area B is larger than the reference slice value and gradually increase, the kickback voltage in the third sub-area B may be smaller than a reference kickback voltage and gradually decrease.

According the exemplary embodiment, as shown in FIG. 8, the kickback voltage KB_E3 is smaller than the kickback voltage KB_C of the comparative example embodiment and gradually decreases, in the second sub-area B.

Therefore, the kickback voltage KB_E3 gradually decreases in the first sub-area A, maintains a constant level in the second sub-area B, and then gradually increases in the third sub-area C. Thus, a luminance difference may be not observed in the boundary area between the second and third sub-areas B and C.

Alternatively, although not shown in figures, the slice values of the gate signals applied to the first and second gate lines GL1, . . . , GLi, GLi+1, . . . , GLj in the first and second sub-area A and B may be determined to be a reference slice value. And then, the slice values of the gate signals applied to the third gate lines GLj+1, . . . , GLn in the third sub-area C may be determined to be smaller than the reference slice value and to gradually decrease. In this case, as the exemplary embodiment shown in FIG. 10, the kickback voltage KB_E4 in the third sub-area C gradually increases from a kickback voltage in a boundary area between the second and third sub-areas B and C, to a last area of the third sub-area C.

Therefore, the kickback voltage KB_E4 gradually decreases in the first sub-area A, maintains a constant level in the second sub-area B, and then gradually increases in the third sub-area C without a discontinuous area. Thus, a luminance difference may be not observed in the boundary area between the second and third sub-areas B and C.

Figure 13:
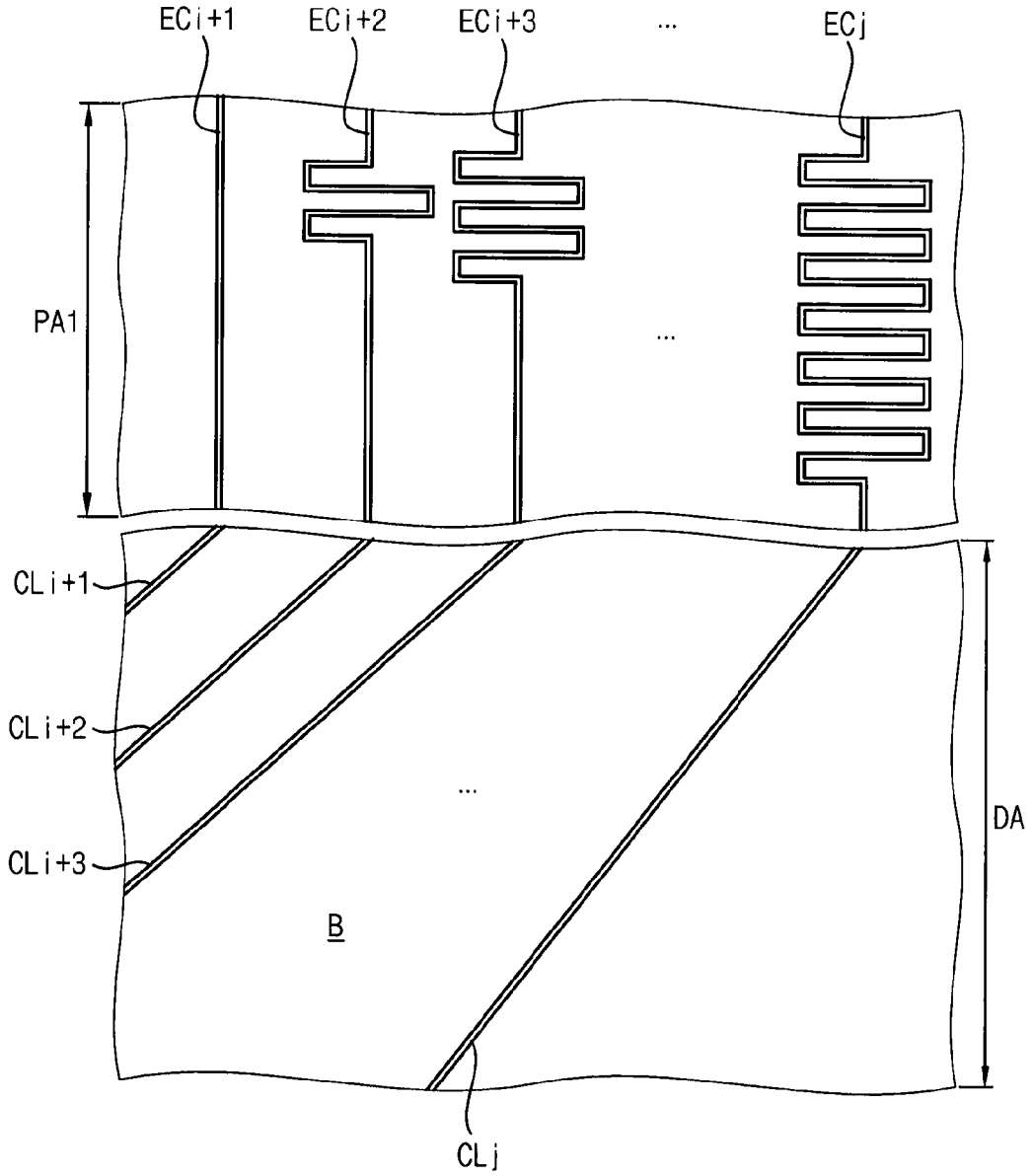
FIG. 13 is a plan view illustrating a peripheral area of a display panel according to an exemplary embodiment.

FIG. 13 is a plan view illustrating a peripheral area of a display panel according to an exemplary embodiment.

Referring to FIGS. 1, 2 and 13, the display panel 100 includes a plurality of storage extension lines ECi+1, ECi+2, ECi+3, . . . , ECj are disposed in the peripheral areas PA and are connected to a plurality of storage lines CLi+1, CLi+2, CLi+3, . . . , CLj in one of the first, second and third sub-areas A, B and C. The plurality of storage extension lines ECi+1, ECi+2, ECi+3, . . . , ECj may have a plurality of loads which are gradually changed. The plurality of storage lines CLi+1, CLi+2, CLi+3, . . . , CLj are connected to a plurality of storage electrodes which overlap a plurality of pixel electrodes in the display area. Each of the pixels P includes a storage capacitor CST which is defined by a pixel electrode, a storage electrode overlapping the pixel electrode and an insulating layer disposed between the pixel electrode and the storage electrode.

Generally, a kickback voltage Vkb may be defined by following Expression 1.

$$Vkb = \frac{Cgs}{Cst + Cgs + Clc}(VON - VOFF) \qquad \text{Expression 1}$$

In Expression 1, Cgs is a gate/source capacitance of a switching element TR, Cst is a storage capacitance of a storage capacitor CST, Clc is a liquid crystal capacitance of a liquid crystal capacitor CLC, VON is a gate-on voltage of a gate signal and VOFF is a gate-off voltage of a gate signal.

Referring to Expression 1, the kickback voltage Vkb may be changed by the gate/source capacitance Cgs, the storage capacitance Cst and the liquid crystal capacitance Clc.

According to the exemplary embodiment, the storage capacitance Cst of the second sub-area B among the first, second and third sub-areas A, B and C may be changed such that the kickback voltage of the second sub-area B may be changed.

For example, in order to change loads of the plurality of storage lines in the second sub-area B, a plurality of storage extension lines ECi+1, ECi+2, ECi+3, . . . , ECj is disposed in the peripheral area corresponding to end portions of the plurality of storage lines CLi+1, CLi+2, CLi+3, . . . , CLj.

The storage extension lines ECi+1, ECi+2, ECi+3, . . . , ECj are connected to the end portions of the storage lines CLi+1, CLi+2, CLi+3, . . . , CLj in the second sub-area B and may be disposed in the first peripheral area PA1 or the second peripheral area PA2.

As shown in FIG. 13, the loads of the storage extension lines ECi+1, ECi+2, ECi+3, . . . , ECj are designed to be gradually increased. Thus, line resistances of the storage lines CLi+1, CLi+2, CLi+3, . . . , CLj connected to the storage extension lines ECi+1, ECi+2, ECi+3, . . . , ECj are gradually increased.

For example, a first storage capacitor connected to an (i+1)-th storage line CLi+1 has a first storage capacitance, a second storage capacitor connected to an (i+2)-th storage line CLi+2 has a second storage capacitance being more than the first storage capacitance and a third storage capacitor connected to an (i+3)-th storage line CLi+3 has a third storage capacitance being more than the second storage capacitance. As described above, the storage capacitances in the second sub-area B may gradually increase.

Thus, the loads of the storage lines CLi+1, CLi+2, CLi+3, . . . , CLj in the second sub-area B gradually increase and thus, the kickback voltage in the second sub-area B may decrease based on Expression 1.

According to the exemplary embodiment, the kickback voltage such as the kickback voltage KB_E3 shown in FIG. 8, is smaller than the kickback voltage KB_C of the comparative example embodiment and gradually decrease in the second sub-area B.

Therefore, as shown in FIG. 8, the kickback voltage KB_E3 gradually decreases in the first sub-area A, maintains a constant level in the second sub-area B, and then gradually increases in the third sub-area C. Thus, a luminance difference may be not observed in the boundary area between the second and third sub-areas B and C.

Figure 14:
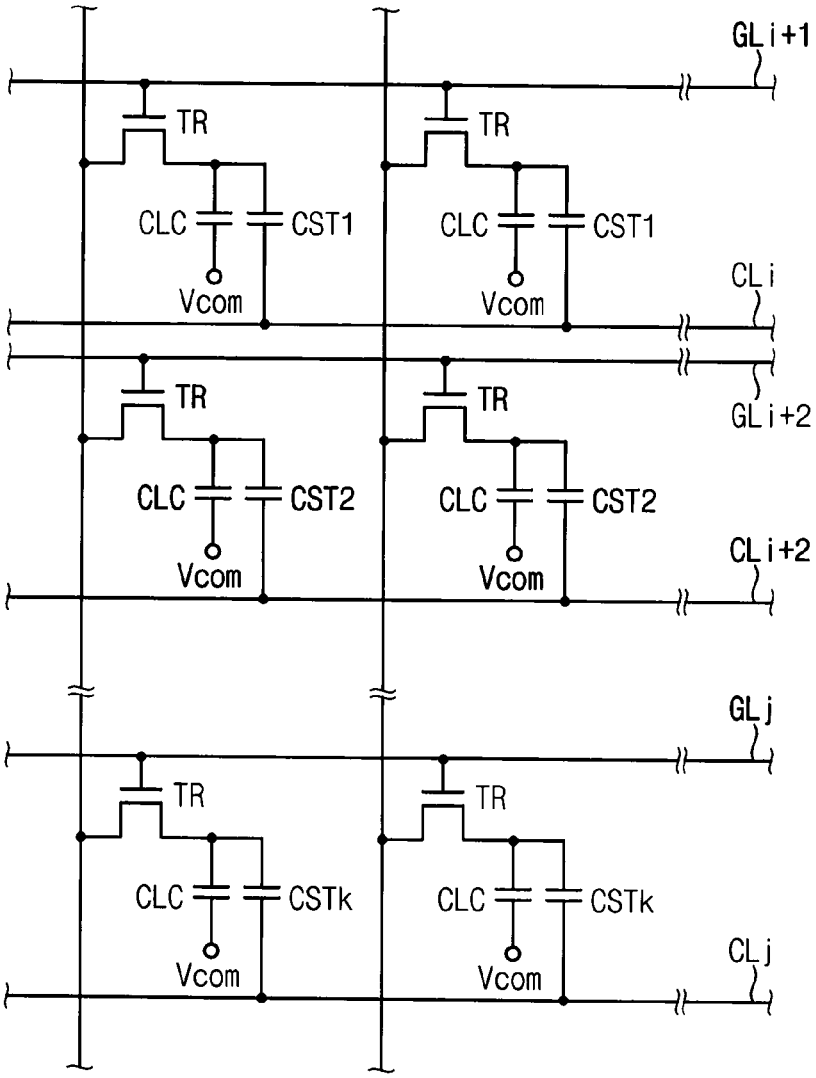
FIG. 14 is an equivalent circuit diagram illustrating a display area of a display panel according to an exemplary embodiment.

FIG. 14 is an equivalent circuit diagram illustrating a display area of a display panel according to an exemplary embodiment.

In comparison with the previous exemplary embodiment as shown in FIG. 13, the display panel according to the exemplary embodiment includes a plurality of storage capacitors which are disposed in the second sub-area B of the display area and have a plurality of capacitances increasing gradually in order to decrease the kickback voltage in the second sub-area B. An overlapping area overlapping the pixel electrode with the storage electrode increases such that a storage capacitance of a storage capacitor increases in the second sub-area B.

For example, a first storage capacitor CST1 connected to an (i+1)-th storage line CLi+1 has a first storage capacitance, a second storage capacitor CST2 connected to an (i+2)-th storage line CLi+2 has a second storage capacitance being more than the first storage capacitance, and a third storage capacitor CST3 connected to an (i+3)-th storage line CLi+3 has a third storage capacitance being more than the second storage capacitance. As described above, the storage capacitances in the second sub-area B may increase.

Thus, the capacitances of the storage capacitor CST1, CST2, CST3, . . . , CSTk in the second sub-area B gradually increase and thus, the kickback voltage in the second sub-area B may decrease based on Expression 1. Wherein, k is a natural number.

According to the exemplary embodiment, the kickback voltage such as the kickback voltage KB_E3 shown in FIG. 8, is smaller than the kickback voltage KB_C of the comparative example embodiment and gradually decrease in the second sub-area B.

Therefore, as shown in FIG. 8, the kickback voltage KB_E3 gradually decreases in the first sub-area A, maintains a constant level in the second sub-area B, and then gradually increases in the third sub-area C. Thus, a luminance difference may be not observed in the boundary area between the second and third sub-areas B and C.

Figure 15:
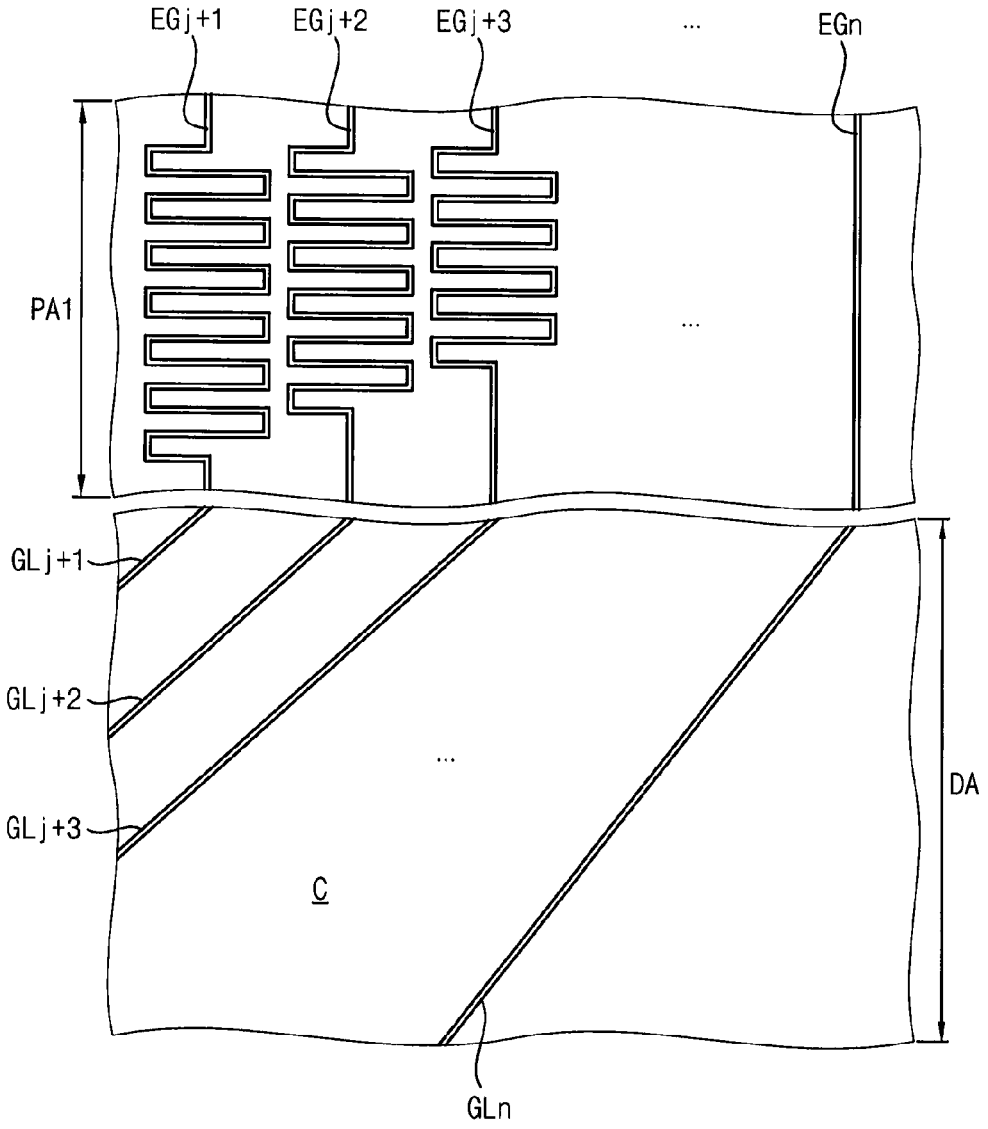
FIG. 15 is a plan view illustrating a peripheral area of a display panel according to an exemplary embodiment.

FIG. 15 is a plan view illustrating a peripheral area of a display panel according to an exemplary embodiment.

Referring to FIGS. 1, 2 and 15, the display panel 100 includes a plurality of gate extension lines which is disposed in the peripheral areas PA and is connected to a plurality of gate lines in one of the first, second and third sub-areas A, B and C. The plurality of gate extension lines may have a plurality of loads which are gradually changed. A gate line is connected to a gate electrode of a switching element TR in a pixel and thus, may adjust a gate/source capacitance Cgs of the switching element TR.

Referring to Expression 1, the kickback voltage Vkb may be changed by the gate/source capacitance Cgs.

According to the exemplary embodiment, the gate/source capacitance Cgs of the third sub-area C among the first, second and third sub-areas A, B and C may be changed such that the kickback voltage of the third sub-area C may be changed.

For example, in order to change loads of the plurality of third gate lines GLj+1, GLj+2, GLj+3, . . . , GLn in the third sub-area C, a plurality of gate extension lines EGj+1, EGj+2, EGj+3, . . . , EGn is disposed in the peripheral area corresponding to end portions of the plurality of third gate lines GLj+1, GLj+2, GLj+3, . . . , GLn.

The gate extension lines EGj+1, EGj+2, EGj+3, . . . , EGn are connected to end portions of the third gate lines GLj+1, GLj+2, GLj+3, . . . , GLn in the third sub-area C and may be disposed in the first peripheral area PA1 or the second peripheral area PA2.

As shown in FIG. 15, the loads of the gate extension lines EGj+1, EGj+2, EGj+3, . . . , EGn are designed to be gradually decreased. Thus, the loads of the third gate lines GLj+1, GLj+2, GLj+3, . . . , GLn connected to the gate extension lines EGj+1, EGj+2, EGj+3, . . . , EGn are gradually decreased.

For example, a switching element connected to a (j+1)-th gate line GLj+1 has a first gate/source capacitance, a switching element connected to a (j+2)-th gate line GLj+2 has a second gate/source capacitance being less than the first gate/source capacitance, and a switching element connected to a (j+3)-th gate line GLj+3 has a third gate/source capacitance being less than the second gate/source capacitance. As described above, the gate/source capacitances in the third sub-area C may gradually decrease.

A kickback voltage according to exemplary embodiment is substantially the same as the kickback voltage KB_E4 shown in FIG. 10.

For example, referring to Expression 1, a first gate/source capacitance corresponding to the (j+1)-th gate line GLj+1 is more than the reference gate/source capacitance and thus, a kickback voltage corresponding to the (j+1)-th gate line GLj+1 increases by a first value.

A second gate/source capacitance corresponding to the (j+2)-th gate line GLj+2 is more than the reference gate/source capacitance and is less than the first gate/source capacitance and thus, a kickback voltage corresponding to the (j+2)-th gate line GLj+2 increases by a second value being less than the first value.

A third gate/source capacitance corresponding to the (j+3)-th gate line GLj+3 is more than the reference gate/source capacitance and is less than the second gate/source capacitance and thus, a kickback voltage corresponding to the (j+3)-th gate line GLj+3 increases by a third value being less than the second value.

The kickback voltage in the third sub-area C according to the exemplary embodiment such as the kickback voltage KB_E4 of the previous exemplary embodiment shown in FIG. 10, continuously increases without a discontinuous area in the boundary area between the second and third sub-areas B and C.

Therefore, as shown in FIG. 10, the kickback voltage KB_E4 gradually decreases in the first sub-area A, maintains a constant level in the second sub-area B, and then gradually increases in the third sub-area C without a discontinuous area. Thus, a luminance difference may be not observed in the boundary area between the second and third sub-areas B and C.

Figure 16:
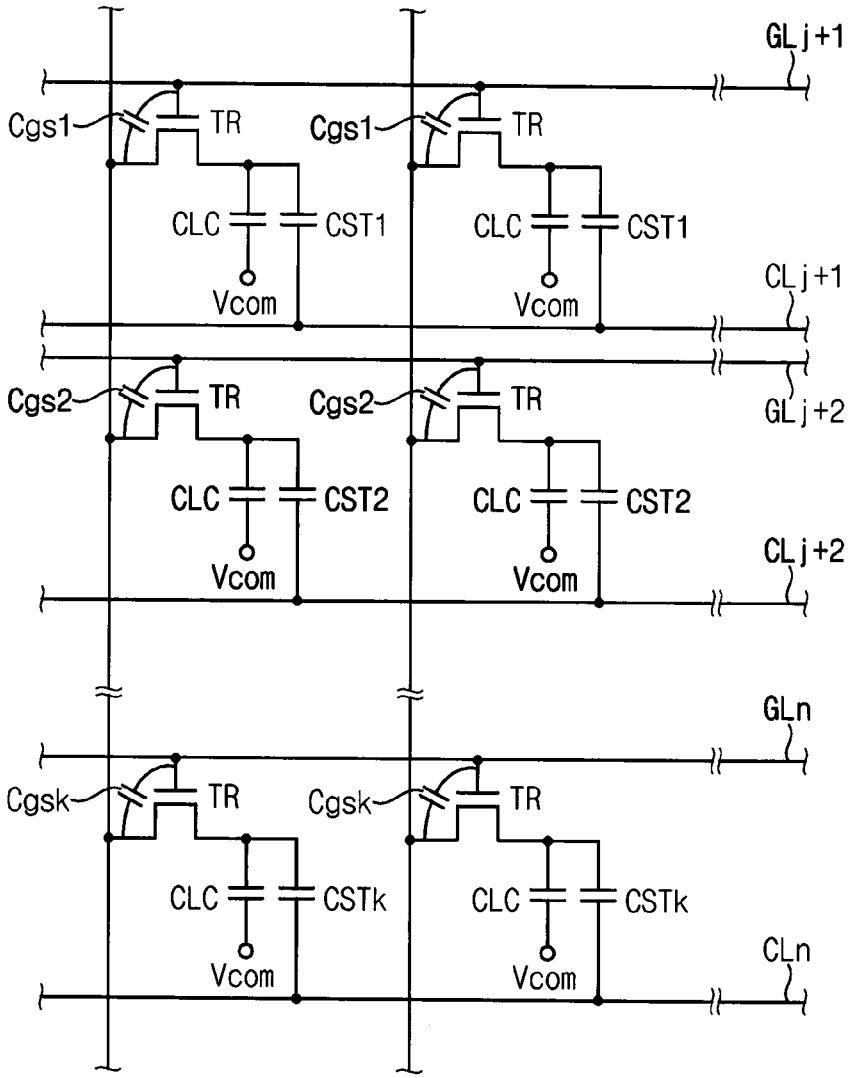
FIG. 16 is an equivalent circuit diagram illustrating a display area of a display panel according to an exemplary embodiment.

FIG. 16 is an equivalent circuit diagram illustrating a display area of a display panel according to an exemplary embodiment.

According to the exemplary embodiment, in order that a kickback voltage in a boundary area between the second and third sub-areas B and C is continuously changed without a discontinuous area, gate/source capacitances of a plurality of switching elements in the third sub-area B are more than a reference gate/source capacitance and gradually decrease. An overlap area in which the gate electrode overlapping the source electrode increases such that the gate/source capacitance increases.

Based on Expression 1, an overlapping area between gate and source electrodes of a switching element connected to a (j+1)-th gate line GLj+1 is more than a reference overlapping area and has a first size. An overlapping area between gate and source electrodes of a switching element connected to a (j+2)-th gate line GLj+2 is more than the reference overlapping area and has a second size being less than the first size. An overlapping area between gate and source electrodes of a switching element connected to a (j+3)-th gate line GLj+3 is more than the reference overlapping area and has a third size being less than the second size.

Thus, according to the exemplary embodiment, a kickback voltage in the second and third sub-areas B and C is continuously changed without a discontinuous area in the boundary area between the second and third sub-areas B and C such as the kickback voltage KB_E4 of the previous exemplary embodiment shown in FIG. 10.

Therefore, as shown in FIG. 10, the kickback voltage KB_E4 gradually decreases in the first sub-area A, maintains a constant level in the second sub-area B, and then gradually increases in the third sub-area C without a discontinuous area. Thus, a luminance difference may be not observed in the boundary area between the second and third sub-areas B and C.

Figure 17:
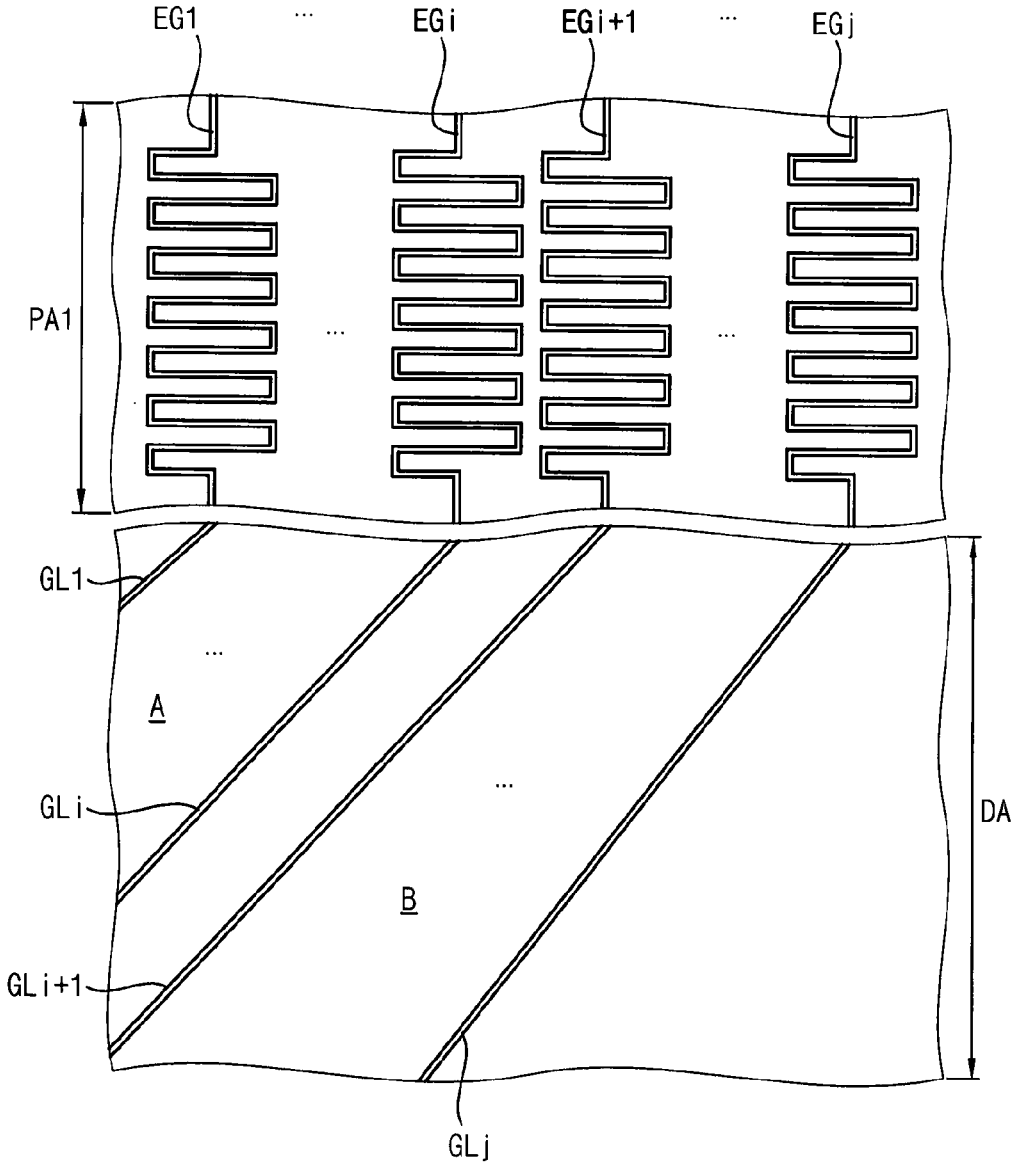
FIG. 17 is a plan view illustrating a peripheral area of a display panel according to an exemplary embodiment.

FIG. 17 is a plan view illustrating a peripheral area of a display panel according to an exemplary embodiment.

Referring to FIGS. 1, 2 and 17, the display panel 100 includes a plurality of first gate extension lines EG1, . . . , EGi which is disposed in the peripheral area PA and is connected to the plurality of gate lines GL1, . . . , GLi in the first sub-area A and a plurality of second gate extension lines EGi+1, . . . , EGj which is disposed in the peripheral area PA and is connected to the plurality of second gate lines GLi+1, . . . , GLj in the second sub-area B. The first gate extension lines EG1, . . . , EGi has a load being equal to a load of the second gate extension lines EGi+1, . . . , EGj.

The first gate extension lines EG1, . . . , EGi and the second gate extension lines EGi+1, . . . , EGj may be disposed in the first peripheral area PA1 or the second peripheral area PA2.

Loads of the third gate lines GLj+1, . . . , GLn in the third sub-area C which are connected to the vertical lines VL1, . . . , VLq are absolutely more than loads of the first gate lines GL1, . . . , GLi in the first sub-area A and the second gate lines GLi+1, . . . , GLj in the second sub-area B by the vertical lines VL1, . . . , VLq.

According to the exemplary embodiment, the first gate lines GL1, . . . , GLi and the second gate lines GLi+1, . . . , GLj are respectively connected to the first gate extension lines EG1, . . . , EGi and the second gate extension lines EGi+1, . . . , EGj corresponding to the load of the vertical line. Thus, the loads of the first gate lines GLi+1, . . . , GLj and the second gate lines GLi+1, . . . , GLj may be compensated similar to the loads of the third gate lines GLj+1, . . . , GLn.

According to the exemplary embodiment, a kickback voltage in the second and third sub-areas B and C is continuously changed without a discontinuous area in the boundary area between the second and third sub-areas B and C such as the kickback voltage KB_E2 of the previous exemplary embodiment shown in FIG. 6.

Therefore, as shown in FIG. 6, the kickback voltage KB_E2 gradually decreases in the first sub-area A, maintains a constant level in the second sub-area B, and then gradually increases in the third sub-area C without a discontinuous area. Thus, a luminance difference may be not observed in the boundary area between the second and third sub-areas B and C.

As described above, according to exemplary embodiments, a gate signal different from a reference gate signal is applied to at least one of the first, second and third sub-areas of the display area such that a kickback voltage of the display area is continuously changed. Thus, a luminance difference of the display area may be removed. In addition, at least one of a storage capacitance of a storage capacitor and a gate/source capacitance of a switching element in at least one of the first, second and third sub-areas may be gradually changed, and thus, the luminance difference of the display area may be removed. In addition, a gate extension line corresponding to a vertical line which is connected to a gate line in the third sub-area is connected to a gate line in the first and second sub-areas and thus, the luminance difference of the display area may be removed.

The foregoing is illustrative of the inventive concept and is not to be construed as limiting thereof. Although a few exemplary embodiments of the inventive concept have been described, those skilled in the art will readily appreciate that many modifications are possible in the exemplary embodiments without materially departing from the novel teachings and advantages of the inventive concept. Accordingly, all such modifications are intended to be included within the scope of the inventive concept as defined in the claims. In the claims, means-plus-function clauses are intended to cover the structures described herein as performing the recited function and not only structural equivalents but also equivalent structures. Therefore, it is to be understood that the foregoing is illustrative of the inventive concept and is not to be construed as limited to the specific exemplary embodiments disclosed, and that modifications to the disclosed exemplary embodiments, as well as other exemplary embodiments, are intended to be included within the scope of the appended claims. The inventive concept is defined by the following claims, with equivalents of the claims to be included therein.

What is claimed is:

1. A display apparatus comprising:

a display panel comprising a plurality of gate lines extending in a first diagonal direction of a display area, and a plurality of vertical lines extending in a vertical direction, the gate lines comprising a plurality of first gate lines disposed in a first sub-area of the display area, a plurality of second gate lines disposed in a second sub-area of the display area, a plurality of third gate lines disposed in a third sub-area of the display area, the third gate lines respectively connected to the vertical lines;

a data driver disposed in a first peripheral area among a plurality of peripheral areas surrounding the display area; and a gate driver disposed in the first peripheral area in which the data driver is disposed and configured to provide first gate signals to the first gate lines, second gate signals to the second gate lines and third gate signals to the third gate lines via the vertical lines, with at least the first gate signals being different from the third gate signals.

2. The display apparatus of claim 1, wherein lengths of the first gate lines in the first sub-area increase in a second diagonal direction crossing the first diagonal direction, lengths of the second gate lines in the second sub-area are the same as each other, and lengths of the third gate lines in the third sub-area decrease in the second diagonal direction.

3. The display apparatus of claim 1, wherein the gate driver is configured to provide the first and second gate lines in the first and second sub-areas with a reference gate-on voltage level, and provide the third gate lines in the third sub-area with a gate-on voltage level higher than the reference gate-on voltage level.

4. The display apparatus of claim 1, wherein the gate driver is configured to provide the first and second gate lines in the first and second sub-areas with a gate-on voltage level lower than a reference gate-on voltage level, and provide the third gate lines in the third sub-area with the reference gate-on voltage level.

5. The display apparatus of claim 1, wherein the gate driver is configured to provide the first and third gate lines in the first and third sub-areas with a reference gate-on voltage level, and provide each of the second gate lines in the second sub-area with respective gate-on voltage levels lower than the reference gate-on voltage level, each sequential one of the respective gate-on voltage levels being lower than a previous one of the respective gate-on voltage levels.

6. The display apparatus of claim 1, wherein the gate driver is configured to provide the first and second gate lines in the first and second sub-areas with a reference gate-on voltage level, provide a first one of the third gate lines in the third sub-area with a gate-on voltage level higher than the reference gate-on voltage level, and provide each of the subsequent third gate lines in the third sub-area with respective gate-on voltage levels lower than the reference gate-on voltage level, each subsequent one of the respective gate-on voltage levels being lower than a previous one of the respective gate-on voltage levels.

7. The display apparatus of claim 1, wherein the first and second gate signals provided to the first and second gate lines in the first and second sub-areas have a reference slice value, and the third gate signals provided to the third gate lines in the third sub-area have a slice value smaller than the reference slice value.

8. The display apparatus of claim 1, wherein the first and second gate signals provided to the first and second gate lines in the first and second sub-areas have a slice value smaller than a reference slice value, and the third gate signals provided to the third gate lines in the third sub-area have the reference slice value.

9. The display apparatus of claim 1, wherein the first and third gate signals provided to the first and third gate lines in the first and third sub-areas have a reference slice value, and the second gate signals provided to the second gate lines in the second sub-area have a slice value larger than the reference slice value, with the slice value of each subsequent second gate signal increasing in value.

10. The display apparatus of claim 1, wherein the first and second gate signals provided to the first and second gate lines in the first and second sub-areas have a reference slice value, and the third gate signals provided to the third gate lines in the third sub-area have a slice value smaller than the reference slice value, with the slice value of each subsequent third gate signal decreasing in value.

11. A display apparatus comprising:

a plurality of gate lines extending in a first diagonal direction of a display area, the gate lines comprising a plurality of first gate lines disposed in a first sub-area, a plurality of second gate lines disposed in a second sub-area, a plurality of third gate lines disposed in a third sub-area;

a plurality of vertical lines extending in a vertical direction and respectively connected to first end portions of the third gate lines;

a plurality of data lines extending in the vertical direction;

a plurality of switching elements, each switching element comprising a gate/source capacitance between a source electrode connected to a corresponding data line and a gate electrode connected to a corresponding gate line;

a plurality of liquid crystal capacitors, each liquid crystal capacitor comprising a pixel electrode connected to the corresponding switching element;

a plurality of storage lines extending parallel with the gate lines; and a plurality of storage capacitors, each storage capacitor having a storage capacitance and comprising a storage electrode which is connected to a first end of a corresponding storage line and overlaps the corresponding pixel electrode, wherein at least one of the storage capacitance of the storage capacitor connected to one of the storage lines and the gate/source capacitance of the switching element connected to one of the gate lines, in at least one of the first, second and third sub-areas, is slightly different than that of the storage capacitor connected to a subsequently adjacent storage line or the switching element connected to a subsequently adjacent gate line.

12. The display apparatus of claim 11, wherein lengths of the first gate lines in the first sub-area increase in a second diagonal direction crossing the first diagonal direction, lengths of the second gate lines in the second sub-area are the same as each other, and lengths of the third gate lines in the third sub-area decrease in the second diagonal direction.

13. The display apparatus of claim 11, further comprises:

a plurality of storage extension lines respectively connected to second end portions of the storage lines in the second sub-area, wherein the storage extension lines have loads gradually changing.

14. The display apparatus of claim 11, wherein the storage capacitance of the storage capacitor connected to a first one of the storage lines in the second sub-area is slightly different from the storage capacitance of the storage capacitor of a subsequently adjacent one of the storage lines.

15. The display apparatus of claim 11, further comprises:

a plurality of gate extension lines connected to end portions of the third gate lines in the third sub-area, wherein each gate extension line has a load slightly different from a load of a subsequently adjacent gate extension line.

16. The display apparatus of claim 11, wherein the gate/source capacitance of each switch element connected to a first one of the third gate lines in the third sub-area is slightly different than the gate/source capacitance of each switching element connected to a subsequently adjacent one of the third gate lines.

17. A display apparatus comprising:

a plurality of gate lines, each having first end portions connected to a gate driver, the plurality of gate lines extending in a first diagonal direction of a display area, the gate lines comprising a plurality of first gate lines disposed in a first sub-area, a plurality of second gate lines disposed in a second sub-area, a plurality of third gate lines disposed in a third sub-area;

a plurality of vertical lines, each having first end portions connected to the gate driver, the plurality of vertical lines extending in a vertical direction across the display area and having second end portions respectively connected to first end portions of the third gate lines;

a plurality of data lines, each having first end portions connected to a data driver, the plurality of data lines extending in the vertical direction across the display area;

a plurality of first gate extension lines disposed in a non-display area and being connected to second end portions of the first gate lines in the first sub-area; and a plurality of second gate extension lines disposed in the non-display area and being connected to second end portions of the second gate lines in the second sub-area.

18. The display apparatus of claim 17, wherein lengths of the first gate lines in the first sub-area increase in a second diagonal direction crossing the first diagonal direction, lengths of the second gate lines in the second sub-area are the same as each other, and lengths of the third gate lines in the third sub-area decrease in the second diagonal direction.

19. The display apparatus of claim 17, wherein each of the first and second gate extension lines has a load being the same as a load of a vertical line.

* * * * *